US010052752B2

(12) United States Patent
Breeden, III et al.

(10) Patent No.: US 10,052,752 B2
(45) Date of Patent: Aug. 21, 2018

(54) MERCHANDIZING SYSTEM FOR DISPLAYING CLEANING DEVICES

(71) Applicant: WINSTON PRODUCTS, Cleveland, OH (US)

(72) Inventors: Winston H. Breeden, III, Chagrin Falls, OH (US); Andrew J. Carcioppolo, Chesterland, OH (US); Robert C. Johnson, Montville, OH (US)

(73) Assignee: WINSTON PRODUCTS, LLC, Cleveland, OH (US)

( * ) Notice: Subject to any disclaimer, the term of this patent is extended or adjusted under 35 U.S.C. 154(b) by 0 days.

(21) Appl. No.: 15/253,033

(22) Filed: Aug. 31, 2016

(65) Prior Publication Data

US 2017/0007043 A1 Jan. 12, 2017

Related U.S. Application Data

(63) Continuation of application No. 14/736,015, filed on Jun. 10, 2015.

(Continued)

(51) Int. Cl.

*A47F 5/08* (2006.01)
*B25G 3/18* (2006.01)

(Continued)

(52) U.S. Cl.

CPC ..... *B25G 3/18* (2013.01); *A47F 5/0006* (2013.01); *A47F 5/0838* (2013.01);

(Continued)

(58) Field of Classification Search

CPC . B65G 3/18; B65G 3/02; A47F 5/0006; A47F 5/0838; A47F 5/0869;

(Continued)

(56) References Cited

U.S. PATENT DOCUMENTS 3,180,528 A * 4/1965 Balint ..... B65D 51/242 206/806
3,370,733 A * 2/1968 Giesler ..... B65D 73/0071 206/216

(Continued)

FOREIGN PATENT DOCUMENTS

WO 2009156068 6/2009
WO 20091156068 12/2009

OTHER PUBLICATIONS

International Preliminary Report on Patentability and Written Opinion of the International Searching Authority—PCT/US2015/035104 dated Dec. 15, 2016.

*Primary Examiner* — Jennifer E. Novosad
(74) *Attorney, Agent, or Firm* — Tucker Ellis LLP; Patrick Clunk

(57) ABSTRACT

A merchandizing system for displaying cleaning head assemblies and handle assemblies including a plurality of rail arms extending from a display wall, a plurality of cleaning head assemblies each having an attachment portion and a cleaning head, and a plurality of hanging mechanisms each having an attachment portion for releasable engagement with one of the attachment portions of the cleaning head assemblies. The cleaning head assemblies are supported from the rail arms by the hanging mechanisms, and the plurality of rail arms are angled downward to allow the cleaning head assemblies to be gravity fed.

18 Claims, 21 Drawing Sheets

Related U.S. Application Data

(60) Provisional application No. 62/010,802, filed on Jun. 10, 2014, provisional application No. 62/010,099, filed on Jun. 10, 2014.

(51) Int. Cl.
*A47L 13/46* (2006.01)
*B25G 3/02* (2006.01)
*A47F 5/00* (2006.01)
*A47F 7/00* (2006.01)

(52) U.S. Cl.
CPC ..... *A47F 5/0869* (2013.01); *A47F 7/0021* (2013.01); *A47L 13/46* (2013.01); *B25G 3/02* (2013.01); *Y10T 16/469* (2015.01)

(58) Field of Classification Search
CPC .... A47F 7/0021; A47F 5/0823; A47F 5/0807; A47F 5/0815; A47F 7/143; A47L 13/46; Y10T 16/469
USPC ..... 211/87.01, 57.1, 59.1; 248/690, 692, 248/682, 304, 339; 206/806
See application file for complete search history.

(56) References Cited

U.S. PATENT DOCUMENTS 4,742,923 A * 5/1988 Calvert ..... A47F 5/0823 211/57.1
5,060,809 A * 10/1991 Bayes ..... A47F 13/085 211/12
5,322,175 A * 6/1994 Nobili ..... B65D 75/36 211/183
5,373,953 A * 12/1994 Fenton ..... B65D 51/242 206/806
5,388,709 A * 2/1995 Adams ..... A47B 57/46 211/106
5,439,120 A * 8/1995 Brozak ..... A47F 5/0838 206/806
5,485,929 A * 1/1996 Danon ..... A47F 5/0869 211/45
5,502,862 A * 4/1996 Vosbikian ..... A46B 5/0095 15/145
5,606,761 A * 3/1997 Lynch ..... A47L 13/022 15/144.4
5,730,290 A * 3/1998 Futo ..... B65D 75/32 206/223
5,855,282 A * 1/1999 Hardy ..... A47F 5/0823 211/106
6,059,124 A * 5/2000 Weck ..... A47F 5/0869 211/57.1
6,102,461 A * 8/2000 Rooney ..... A47F 5/0006 248/497
6,131,748 A * 10/2000 Kawasaki ..... A47F 1/128 211/54.1
6,244,444 B1 * 6/2001 Jacobus ..... B65D 25/205 206/470
6,581,894 B1 * 6/2003 Tong ..... A47F 5/0006 206/378
6,604,637 B2 * 8/2003 Lane ..... A47F 5/0823 211/57.1
6,634,501 B2 * 10/2003 Su ..... B25H 3/003 206/1.5
6,672,457 B2 * 1/2004 Aylesworth ..... B65D 51/24 206/277
6,749,161 B1 * 6/2004 Will ..... A47F 5/0846 211/57.1
6,811,128 B1 * 11/2004 Wagner ..... A47F 5/0823 211/57.1
D533,002 S * 12/2006 Recknagel ..... D6/566
7,219,806 B1 * 5/2007 Morrow ..... A47F 5/0869 211/59.1
D547,955 S * 8/2007 Johnson ..... D6/566
7,533,916 B2 * 5/2009 Eichenbaum ..... A45F 5/1026 294/159
7,566,037 B2 * 7/2009 Vogler ..... A47F 1/128 211/54.1
7,584,930 B2 * 9/2009 Zich ..... A47F 5/0861 211/57.1
7,905,363 B2 * 3/2011 Aarts ..... A47F 5/0869 211/57.1
8,186,509 B2 * 5/2012 Samelson ..... A47F 5/0006 206/326
8,240,486 B2 * 8/2012 Niederhuefner ..... A47F 1/128 211/51
8,439,415 B2 * 5/2013 Valaas ..... A45F 5/10 12/120.5
8,443,972 B1 * 5/2013 Pendergraph ..... B65D 73/0064 206/349
8,479,927 B2 * 7/2013 Vulpitta ..... A47F 5/0823 211/106
8,499,941 B2 * 8/2013 Barkdoll ..... A47F 5/0823 211/59.1
D709,760 S * 7/2014 Castell, Jr. ..... D9/434
9,010,279 B1 * 4/2015 Saber ..... A01K 27/008 119/702
9,113,737 B2 * 8/2015 Goldstein ..... A47G 25/743
9,265,361 B1 * 2/2016 Streich ..... B65D 75/56
9,655,459 B1 * 5/2017 Peng ..... A47F 7/0021
2002/0113183 A1 * 8/2002 Mattesky ..... A47F 5/0823 248/220.41
2003/0235463 A1 12/2003 Neumann
2004/0035809 A1 * 2/2004 Su ..... A47F 3/0469 211/86.01
2004/0145198 A1 * 7/2004 Tomchak ..... A01B 1/22 294/57
2005/0230587 A1 * 10/2005 Yang ..... B65D 73/0064 248/314
2006/0113261 A1 * 6/2006 Recknagel ..... A47F 5/0838 211/59.1
2007/0017072 A1 * 1/2007 Serio ..... A47L 13/42 24/573.11
2007/0034581 A1 * 2/2007 Weck ..... A47F 5/0823 211/59.1
2007/0034771 A1 * 2/2007 Liu ..... A47F 5/0006 248/682
2008/0296242 A1 * 12/2008 Worden ..... A47F 5/0006 211/113
2014/0047745 A1 * 2/2014 Wildrick ..... A47F 1/04 40/661.06
2014/0290316 A1 * 10/2014 Chen ..... A47F 5/0006 70/61
2015/0352707 A1 * 12/2015 Breeden, III ..... B25G 3/18 15/104.001
2016/0058210 A1 * 3/2016 Strassburger ..... A47F 7/02 248/340
2016/0135616 A1 * 5/2016 Fisher ..... A47F 7/00 211/13.1

* cited by examiner

MERCHANDIZING SYSTEM FOR DISPLAYING CLEANING DEVICES

RELATED APPLICATIONS

This application is a continuation of U.S. patent application Ser. No. 14/736,015 filed Jun. 10, 2015, which claims the benefit of U.S. Provisional Application No. 62/010,082 filed Jun. 10, 2014 and U.S. Provisional Application No. 62/010,099 filed Jun. 10, 2014, which are hereby incorporated herein by reference.

FIELD OF INVENTION

The present invention relates generally to cleaning devices, and more particularly to cleaning devices with interchangeable handles and cleaning heads.

BACKGROUND

Cleaning devices, such as brooms, mops, household cleaning brushes, dusters, cloths, fabric mitts, pads, sponges, squeegees, etc., include elongate handles affixed to cleaning heads of the devices, such as broom heads, mop heads, brush heads, duster heads, fabric mitt heads, pad heads, sponge heads, squeegee heads, etc. The handles typically have a fixed length and diameter, although the handles may also have an adjustable length. In some instances, such as with push brooms, the handle may be secured to the broom head by a threaded connection.

SUMMARY OF INVENTION

The present application is directed to a cleaning device having a cleaning head assembly and a handle assembly. The assemblies are removably attached to one another by a locking mechanism that includes a female attachment portion having a receptacle and being affixed to a cleaning head, and a male attachment portion having a locking projection and being affixed to a handle and adapted for removable engagement with the female attachment portion. The locking projection on the male attachment portion is biased to engage the receptacle in the female attachment portion so as to releaseably lock the cleaning head and the handle together.

According to an aspect, a locking mechanism for the removable attachment of a cleaning head to a handle is provided. The locking mechanism includes a female attachment portion having a receptacle and being affixed to a cleaning head, and a male attachment portion having a locking projection and being affixed to a handle and adapted for removable engagement with the female attachment portion, the locking projection on the male attachment portion being biased to engage the receptacle in the female attachment portion so as to releaseably lock the cleaning head and the handle together, wherein the female and male attachment portions have corresponding cross-sections that prevent rotation of the handle relative to the cleaning head when engaged.

The female and the male attachment portions each have substantially triangular cross-sections to prevent rotation of the handle relative to the cleaning head when engaged.

The female and male attachment portions each have corresponding alignment members such that when the alignment portions mate the female and male attachment portions are aligned and relative rotation of the male attachment portion relative to the female attachment portion is restricted.

The alignment member of the female attachment portion is a groove and the alignment member of the male attachment portion is a projection.

The groove and projection extend axially along the respective attachment portion.

The locking projection is resiliently deflectable in a deflection direction perpendicular to an insertion direction of the handle.

The locking projection is deflectable in the deflection direction during insertion/removal of the male attachment portion in/from the female attachment portion.

The male attachment portion has first and second axially extending portions each having a substantially similar cross-section, and wherein the cross-section of the first axially extending portion is larger than the cross-section of the second axially extending portion.

The first and second axially extending portions each have a substantially triangular cross-section.

The female attachment portion has first and second axially extending portions each having a substantially similar cross-section, and wherein the cross-section of the first axially extending portion is larger than the cross-section of the second axially extending portion.

The first and second axially extending portions each have a substantially triangular cross-section.

The female attachment portion has laterally projecting portions with one or more openings for receiving a fastener to affix the female attachment portion to the cleaning head.

The female attachment portion is integrally formed with the cleaning head.

The female attachment portion is pivotable relative to the cleaning head.

The male attachment portion includes a stop for preventing over insertion of the handle in the male attachment portion.

The male attachment portion includes an opening for receiving a fastener to secure the handle to the male attachment portion.

The locking mechanism further includes a cap having a first end with a cross-section matching a cross-section of the handle and a second end with a cross-section matching the cross-section of the male attachment portion.

The first end of the cap has a substantially circular cross-section and the second end of the cap has a substantially triangular cross-section.

The cap includes an opening for receiving a fastener to secure the handle to the male attachment portion.

The female attachment portion includes a stop for preventing over insertion of the male attachment portion.

According to another aspect, a locking mechanism for the removable attachment of a cleaning head to a handle is provided, the locking mechanism including a female attachment portion having first and second ends, an axially extending cavity for receiving a male attachment portion at the first end, a receptacle extending through a wall of the female attachment portion, and an alignment member, the female attachment portion being affixed to the cleaning head at the second end, the male attachment portion having a first end adapted to be received in the cavity of the female attachment portion, a second end, an axially extending cavity for receiving the handle at the second end, a locking projection engageable with the receptacle to releaseably lock the male attachment portion to the female attachment portion, and an alignment member, whereby when the male attachment portion is being received in the cavity of the female attachment portion, the alignment member of the male attachment portion mates with the corresponding alignment member of the female attachment portion thereby aligning the male and female attachment portions and restricting relative rotation of the male attachment portion relative to the female attachment portion.

The alignment member of the female attachment portion is a groove and the alignment member of the male attachment portion is a projection.

The groove and projection extend axially along the respective attachment portion.

The female and male attachment portions have corresponding cross-sections that prevent rotation of the handle relative to the cleaning head when engaged.

The female and the male attachment portions each have substantially triangular cross-sections to prevent rotation of the handle relative to the cleaning head when engaged.

The locking projection is resiliently deflectable in a deflection direction perpendicular to an insertion direction of the handle.

The locking projection is deflectable in the deflection direction during insertion/removal of the male attachment portion in/from the female attachment portion.

The male attachment portion has first and second axially extending portions each having a substantially similar cross-section, and wherein the cross-section of the first axially extending portion is larger than the cross-section of the second axially extending portion.

The first and second axially extending portions each have a substantially triangular cross-section.

The female attachment portion has first and second axially extending portions each having a substantially similar cross-section, and wherein the cross-section of the first axially extending portion is larger than the cross-section of the second axially extending portion.

The first and second axially extending portions each have a substantially triangular cross-section.

The male attachment portion includes a stop in the cavity for preventing over insertion of the handle in the male attachment portion.

The male attachment portion includes an opening near the second end for receiving a fastener to secure the handle to the male attachment portion.

The locking mechanism further includes a cap affixed to the second end of the male attachment portion, wherein the cap has a first end with a cross-section matching a cross-section of the handle and a second end with a cross-section matching the cross-section of the male attachment portion.

The first end of the cap has a substantially circular cross-section and the second end of the cap has a substantially triangular cross-section.

The cap includes an opening for receiving a fastener to secure the handle to the male attachment portion.

The male attachment portion includes an axially opening recess opening from the first end to the locking projection.

The female attachment portion includes a stop for preventing over insertion of the male attachment portion.

According to still another aspect, a system of interchangeable products is provided that includes a cleaning head having a female attachment portion, a handle having a male attachment portion for releasable engagement with the female attachment portion of the cleaning head, and a hanging mechanism having a male attachment portion for releasable engagement with the female attachment portion of the cleaning head for display of the cleaning head.

The female attachment portion has a receptacle and the male attachment portion of both the handle and the hanging mechanism has a locking projection engageable with the receptacle to releaseably lock the cleaning head and the handle/hanging mechanism together.

The male attachment portion of the hanging mechanism is adapted to be received in the female attachment portion and the locking projection is adapted to extend out of the female attachment portion when engaged with the receptacle.

The locking projection of the hanging mechanism has an opening extending therethrough for receiving a securing member to prevent disengagement of the locking projection of the hanging mechanism from the receptacle of the female attachment portion.

When engaged, the opening in the locking projection is out of the female attachment portion past the receptacle.

The hanging mechanism includes a laterally extending portion substantially perpendicular to the male attachment portion such that the hanging mechanism is substantially t-shaped, and wherein the laterally extending portion is configured to interact with a pair of rail arms extending from a display wall. The laterally extending portion includes a guide extending from both ends of the laterally extending portion in a direction parallel to the male attachment portion.

According to a further aspect, a system of interchangeable products is provided that includes a cleaning head having a female attachment portion, and a hanging mechanism having a male attachment portion for releasable engagement with the female attachment portion of the cleaning head for display of the cleaning head, wherein the female attachment portion has a receptacle for receiving and engaging with the male attachment portion to releaseably lock the cleaning head and the hanging mechanism together.

The receptacle has threads for mating with threads on the male attachment portion to releaseably lock the cleaning head and the hanging mechanism together.

The male attachment portion has a locking portion engageable with the receptacle to releaseably lock the cleaning head and the hanging mechanism together.

The male attachment portion of the hanging mechanism is adapted to be received in the female attachment portion and the locking projection is adapted to extend out of the female attachment portion when engaged with the receptacle.

The locking projection of the hanging mechanism has an opening extending therethrough for receiving a securing member to prevent disengagement of the locking projection of the hanging mechanism from the receptacle of the female attachment portion.

When engaged, the opening in the locking projection extends out of the female attachment portion past the receptacle.

The hanging mechanism includes a laterally extending portion substantially perpendicular to the male attachment portion such that the hanging mechanism is substantially t-shaped, and wherein the laterally extending portion is configured to interact with a pair of rail arms extending from a display wall.

The laterally extending portion includes a guide extending from both ends of the laterally extending portion in a direction parallel to the male attachment portion.

According to a further aspect, a merchandizing system for displaying cleaning head assemblies and/or handle assemblies is provided. The system includes a plurality of rail arms extending from a display wall, a plurality of cleaning head assemblies each having an attachment portion and a cleaning head, and a plurality of hanging mechanism each having an attachment portion for releasable engagement with the corresponding attachment portion of one of the cleaning head assemblies, wherein the cleaning head assemblies are configured to be supported from the rail arms by the hanging mechanisms.

The plurality of rail arms includes a plurality of pairs of rail arms, and wherein each hanging mechanism hangs from a pair of the rail arms.

Each hanging mechanism includes a laterally extending portion substantially perpendicular to the attachment portion such that the hanging mechanism is substantially t-shaped, and wherein the laterally extending portion is configured to interact with one of the pairs of rail arms.

Each laterally extending portion includes a guide extending from both ends of the laterally extending portion in a direction parallel to the attachment portion.

The attachment portion of each cleaning head assembly is a female attachment portion and the attachment portion of each hanging mechanism is a male attachment portion, and wherein each female attachment portion has a receptacle for receiving and engaging with the respective male attachment portion to releaseably lock the cleaning head and the hanging mechanism together.

The receptacle has threads for mating with threads on the male attachment portion to releaseably lock the cleaning head and the hanging mechanism together.

The male attachment portion has a locking portion engageable with the receptacle to releaseably lock the cleaning head and the hanging mechanism together.

The male attachment portion of the hanging mechanism is adapted to be received in the female attachment portion and the locking projection is adapted to extend out of the female attachment portion when engaged with the receptacle.

The locking projection of the hanging mechanism has an opening extending therethrough for receiving a securing member to prevent disengagement of the locking projection of the hanging mechanism from the receptacle of the female attachment portion.

When engaged, the opening in the locking projection extends out of the female attachment portion past the receptacle.

The system may further include a plurality of hook arms extending from the display wall for supporting the plurality of handle assemblies.

The system may further include the display wall.

The foregoing and other features of the application are hereinafter described in greater detail with reference to the accompanying drawings.

DETAILED DESCRIPTION

Figure 1:
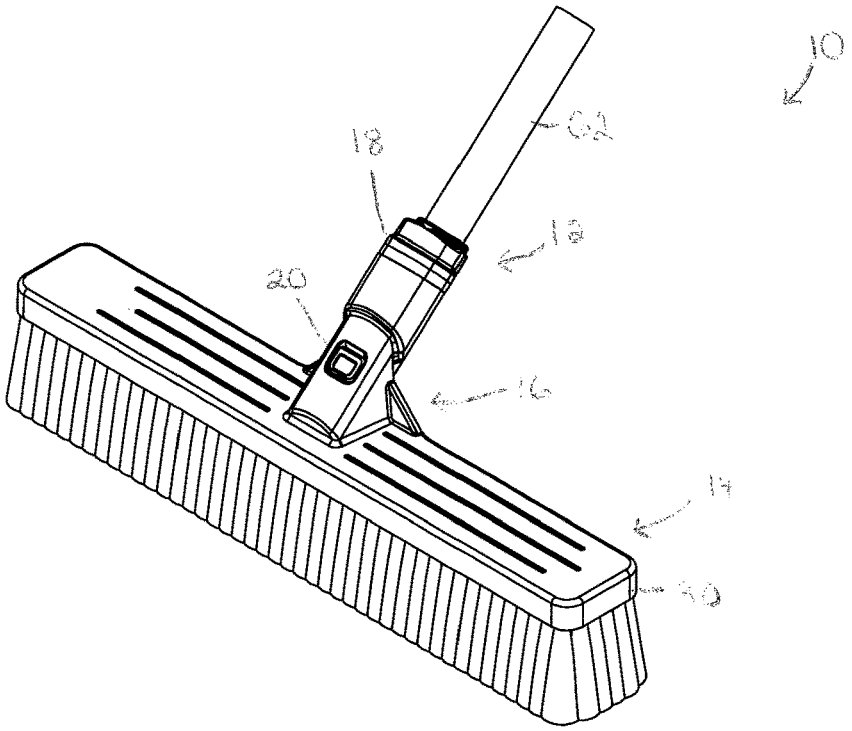
FIG. 1 is a perspective view of a representative embodiment of a cleaning device.
Figure 2:
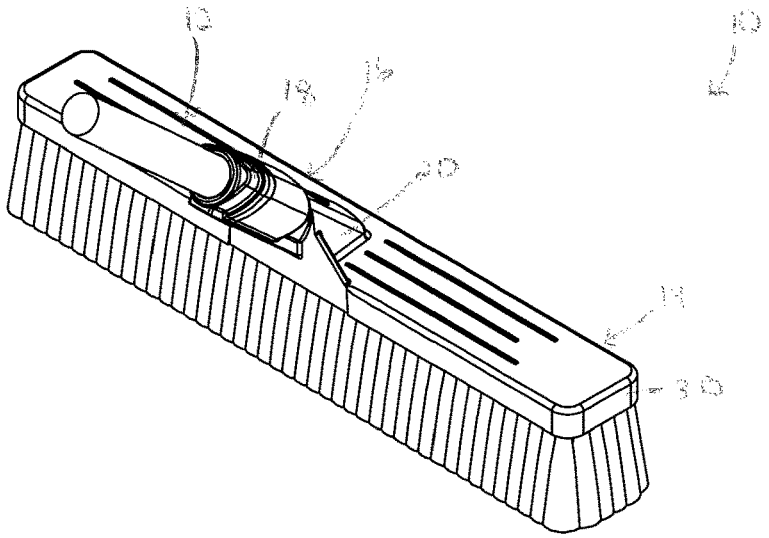
FIG. 2 is another perspective view of the cleaning device.
Figure 3:
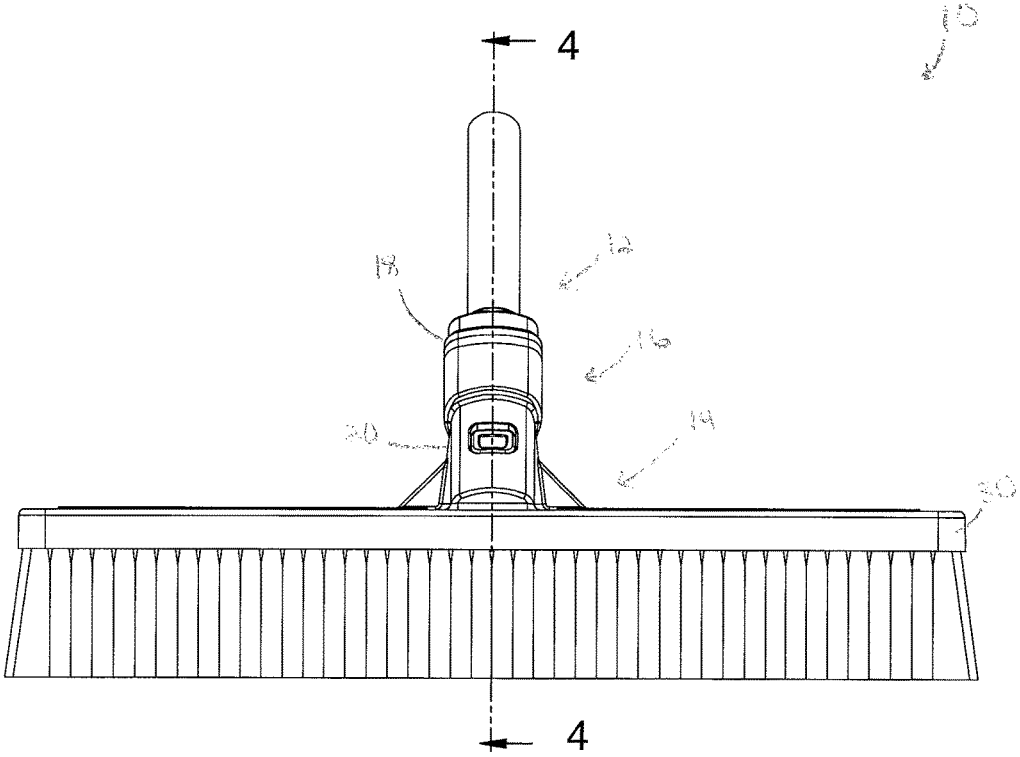
FIG. 3 is a front view of the cleaning device.
Figure 4:
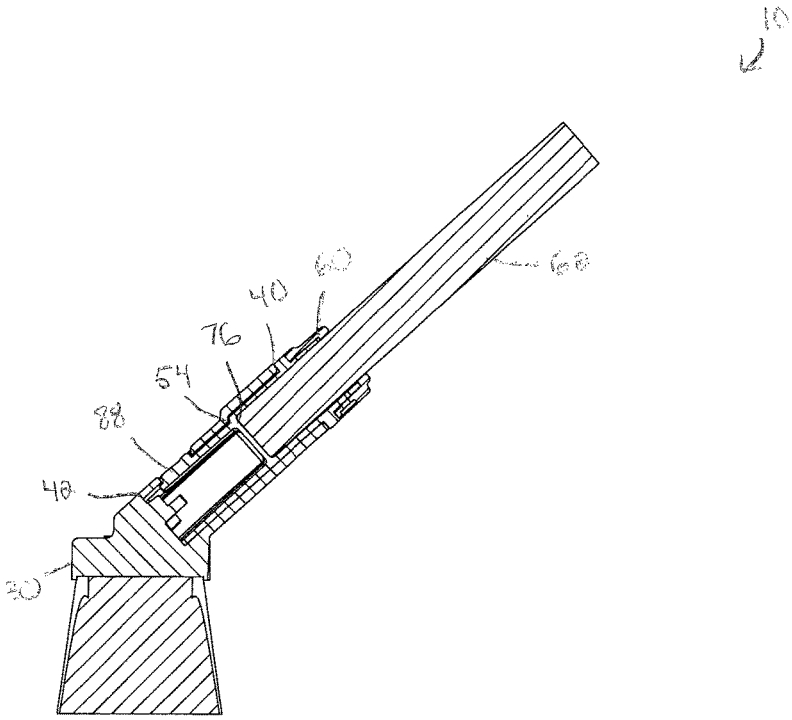
FIG. 4 is a cross-sectional view of the cleaning device taken about line 4-4 in FIG. 3.

The principles of the present application have particular application to a locking mechanism for cleaning devices, such as brooms, mops, etc., and thus will be described below chiefly in this context. It will of course be appreciated that principles of the application may be applicable to handled tools, such as rakes, painting tools, such as rollers, etc.

Turning now to FIGS. 1-4, a cleaning device is shown generally at reference numeral 10. The cleaning device may be any suitable cleaning device, such as a broom, mop, household cleaning brush, duster, cloth, fabric mitt, pad, sponge, squeegee, etc. The cleaning device includes a handle assembly 12 removably attachable to a cleaning head assembly 14. The handle assembly 12 is attachable to the cleaning head assembly 14 using a locking mechanism 16 that includes a male attachment portion 18 forming part of the handle assembly 12 and a female attachment portion 20 forming part of the cleaning head assembly 14 as described in detail below. Using the locking mechanism 16, different handles may be substituted for one another, such as handles of varying lengths and diameters, and different cleaning heads may be used with the various handles.

Figure 5:
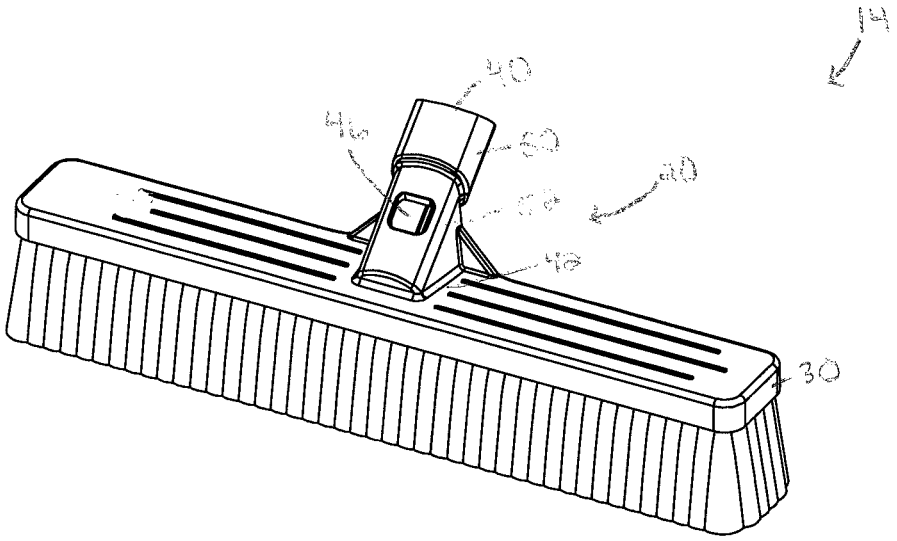
FIG. 5 is a perspective view of a cleaning head assembly of the cleaning device.
Figure 6:
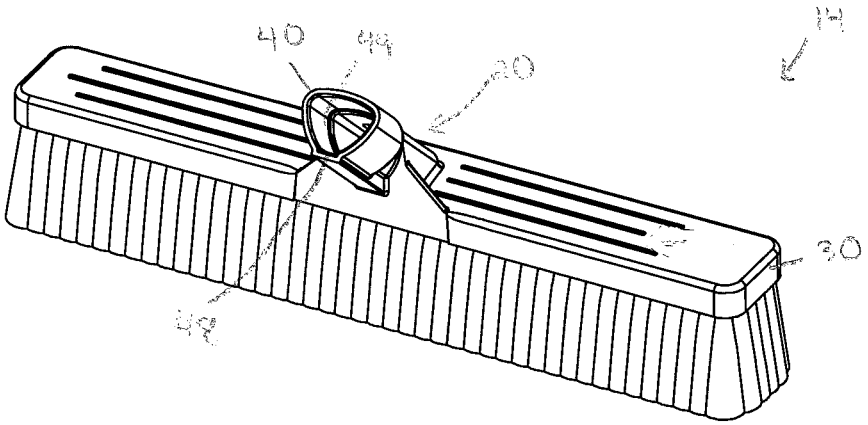
FIG. 6 is another perspective view of the cleaning head assembly.
Figure 9:
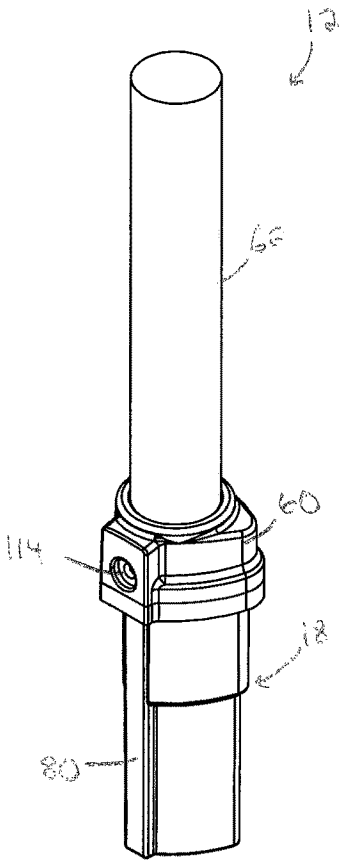
FIG. 9 is still another perspective view of the handle assembly.
Figure 8:
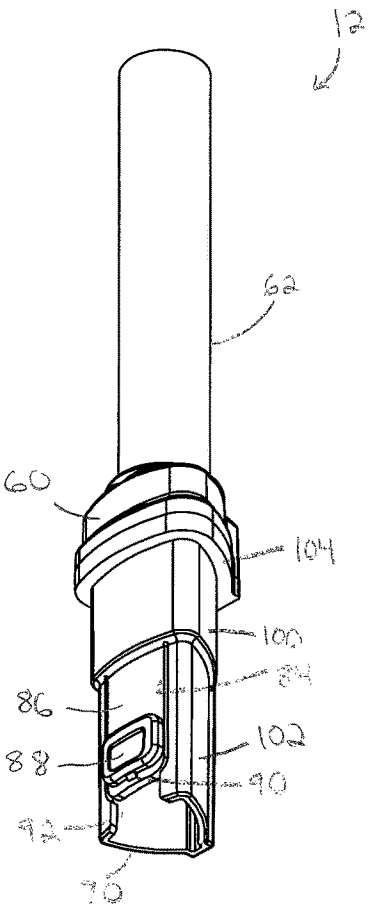
FIG. 8 is another perspective view of the handle assembly.
Figure 7:
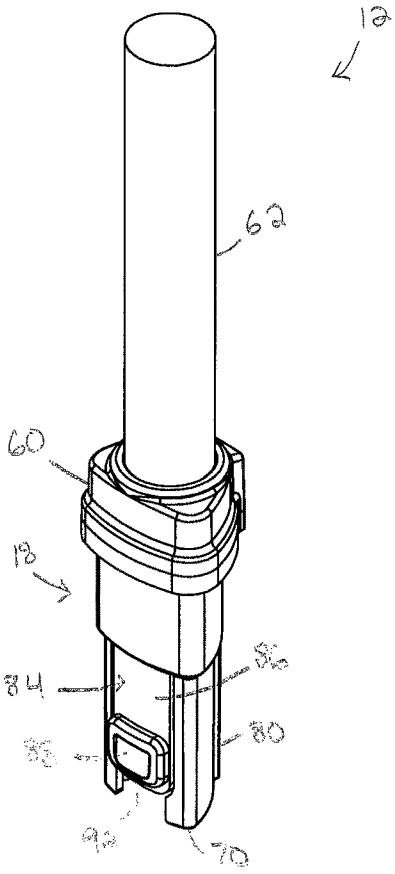
FIG. 7 is a perspective view of a handle assembly of the cleaning device.
Figure 10:
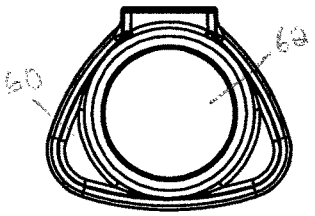
FIG. 10 is a top view of the handle assembly.
Figure 11:
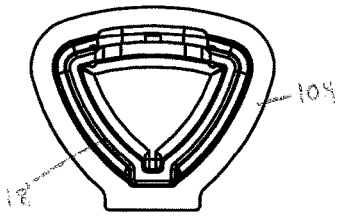
FIG. 11 is a bottom view of the handle assembly.
Figure 12:
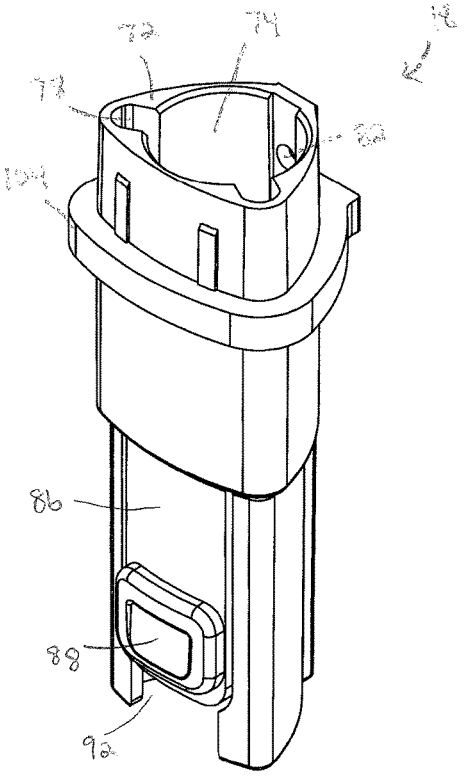
FIG. 12 is a perspective view of a male attachment portion of the handle assembly.
Figure 13:
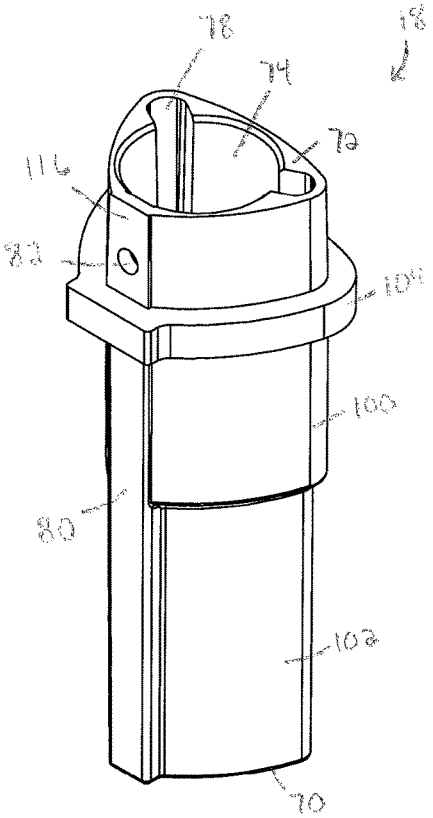
FIG. 13 is another perspective view of the male attachment portion.
Figure 14:
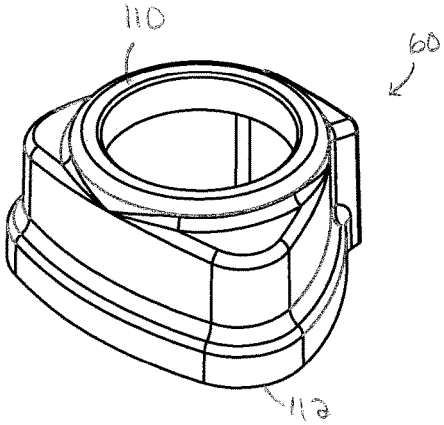
FIG. 14 is a perspective view of a representative embodiment of a cap of the handle assembly.
Figure 15:
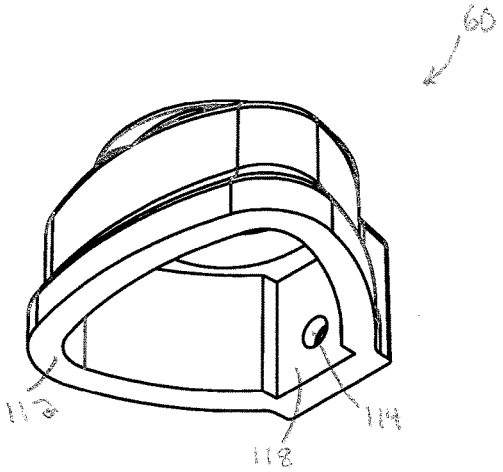
FIG. 15 is another perspective view of the cap of the handle assembly.
Figure 16:
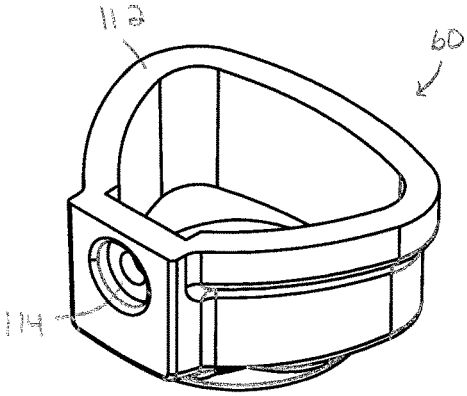
FIG. 16 is yet another perspective view of the cap of the handle assembly.
Figure 17:
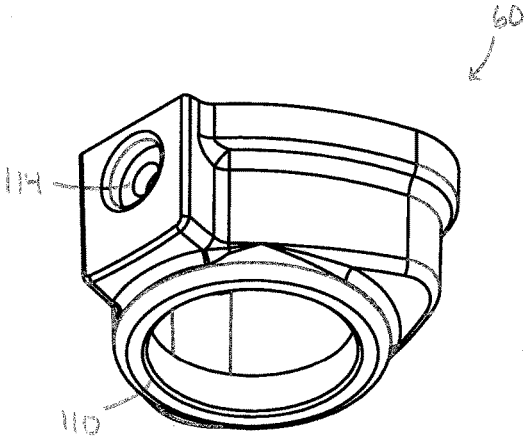
FIG. 17 is still another perspective view of the cap of the handle assembly.
Figure 18:
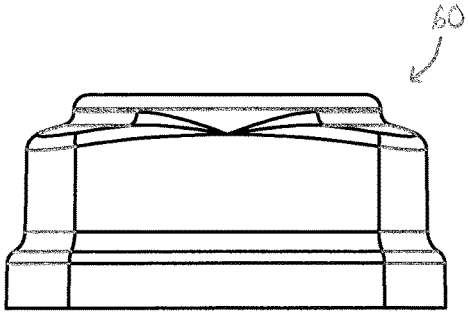
FIG. 18 is a front view of the cap.
Figure 19:
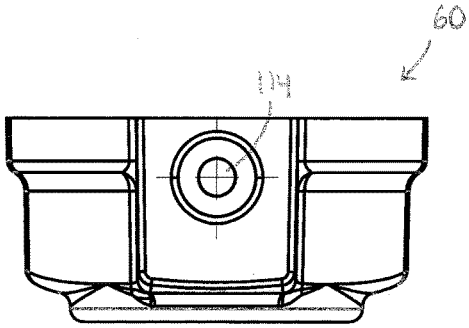
FIG. 19 is a rear view of the cap.
Figure 20:
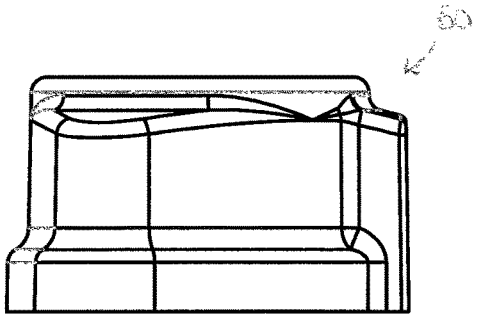
FIG. 20 is a right side view of the cap.
Figure 21:
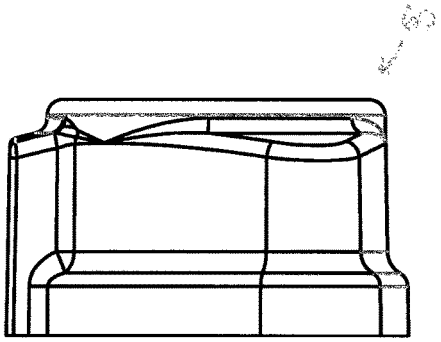
FIG. 21 is a left side view of the cap.
Figure 22:
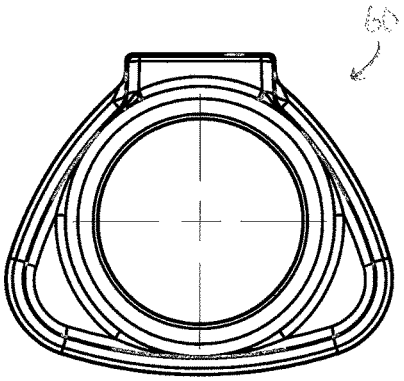
FIG. 22 is a top view of the cap.
Figure 23:
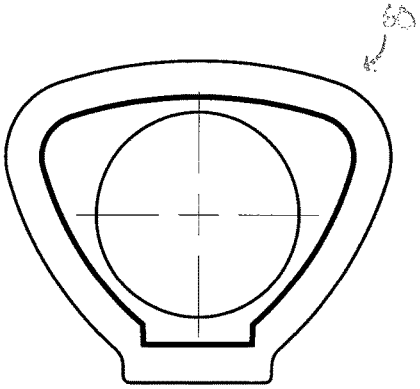
FIG. 23 is a bottom view of the cap.
Figure 27:
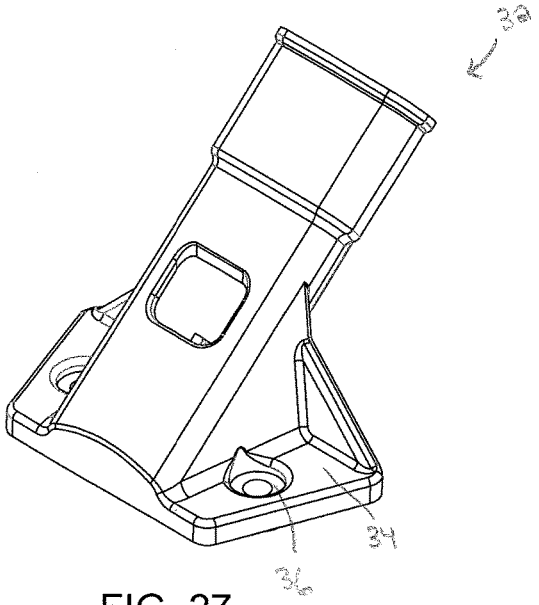
FIG. 27 is a perspective view of another representative embodiment of a female attachment portion.
Figure 28:
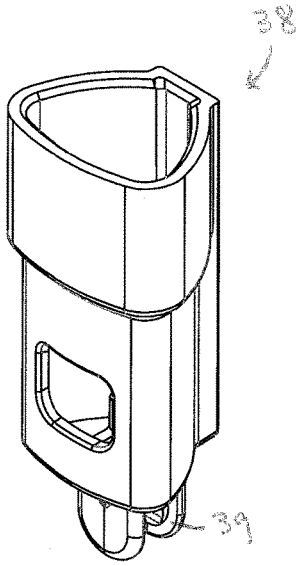
FIG. 28 is a perspective view of still another representative embodiment of a female attachment portion.

Referring now to FIGS. 5 and 6 in addition to FIGS. 1-4, the cleaning head assembly 14 includes the female attachment portion 20 and a cleaning head 30, which is illustrated as a push broom head but may be any suitable head, such as a mop head, brush head, duster head, fabric mitt head, pad head, sponge head, squeegee head, etc. The female attachment portion 20 may be integrally formed with the cleaning head as a one-piece design as shown, or may be affixed to the cleaning head 30 in any suitable manner. For example, as shown by the female attachment portion 32 in FIG. 27, which is substantially the same as the female attachment portion 20, the female attachment portion 32 has laterally projecting portions 34 each with one or more openings 36 for receiving a fastener to affix the female attachment portion 32 to the cleaning head. Alternatively, as shown by the female attachment portion 38 in FIG. 28, which is substantially the same as the female attachment portion 20, the female attachment portion 38 is affixed to the cleaning head via projections 39 such that the female attachment portion 38 is pivotable relative to the cleaning head. It will be appreciated that aspects of the female attachment portions may be substituted for one another or used in conjunction with one another where applicable.

The female attachment portion 20 has a first end 40, a second end 42 affixed to or integrally formed with the cleaning head 30, and an axially extending cavity 44 for receiving the male attachment portion 18 at the first end 40. The bottom of the axially extending cavity 44 may serve as a stop for the male attachment portion 18. The female attachment portion also includes a receptacle 46, such as a snap-fit receptacle extending through a wall of the female attachment portion 20 for engaging with a locking projection on the male attachment portion 18, and an alignment member 48 for aligning with a corresponding alignment member on the male attachment portion 18.

The female attachment portion has first and second axially extending portions 50 and 52 each having a substantially similar cross-section. The cross-section of the first axially extending portion 50 is larger than the cross-section of the second axially extending portion 52, and each portion is sized to receive a corresponding portion of the male attachment portion 18. The first axially extending portion 50 defines a shoulder 54, shown in FIG. 4, which may serve as a stop for the corresponding portion of the male attachment portion 18 to abut.

Turning now to FIGS. 7-23, and initially to FIGS. 7-13, the handle assembly 12 includes the male attachment portion 18, a cap 60 secured to the male attachment portion 18, and a handle 62 affixed to the male attachment portion 18, where the handle may be any suitable handle of a suitable length. It will be appreciated that the male attachment portion 18 and the cap 60 may be integrally formed or secured separate components secured in any suitable manner.

The male attachment portion 18 has a first end 70 adapted to be received in the cavity 44 of the female attachment portion 20, a second end 72 secured to the cap 60, and an axially extending cavity 74 for receiving the handle 62 at the second end 72. A stop 76 (FIG. 4) in the form of an inner wall is provided at the end of the axially extending cavity 74 for preventing over insertion of the handle 62 in the male attachment portion 18. One or more bores, and in the illustrated embodiment a pair of bores 78 extend substantially along the length of the axially extending cavity 74. The bores 78 provide a tolerance for a handle 62 having a diameter larger than a diameter of the axially extending cavity 74 so that the handle 62 may be substantially secured in the axially extending cavity 74 via a friction fit.

The male attachment portion 18 includes an alignment member 80 for mating with the alignment member 48 of the female attachment portion 20, and an opening 82 for receiving a fastener to affix the handle 62 to the male attachment portion 18. The male attachment portion 18 also includes a locking projection 84 biased to engage the receptacle 46 to releaseably lock the male attachment portion 18 to the female attachment portion 20. The locking projection 84 has an axially extending member 86 or tab having a fixed end and a free end, a radially outwardly projecting portion 88 or catch proximate the free end of the tab 86 that engages the receptacle 46 to be disposed in or extend beyond the receptacle, and a projection 90 at an end of the tab 86 that aids in deflection.

Figure 26:
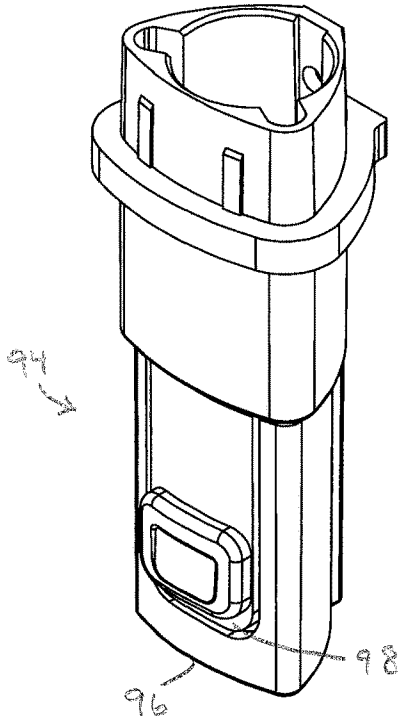
FIG. 26 is a perspective view of a male attachment portion of the handle assembly of FIG. 24.
Figure 25:
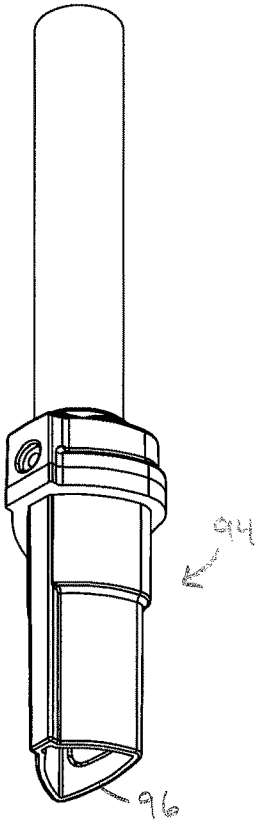
FIG. 25 is another perspective view of the handle assembly of FIG. 24.
Figure 24:
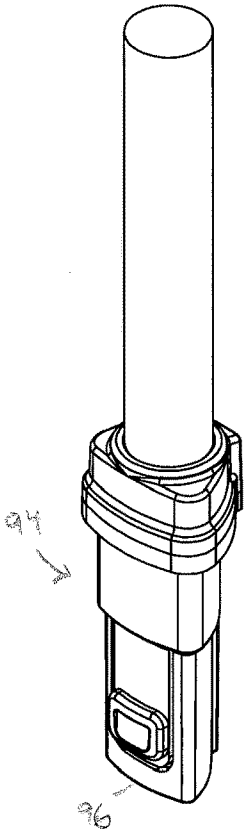
FIG. 24 is a perspective view of another representative embodiment of a handle assembly of the cleaning device.

The locking projection 84 is resiliently deflectable in a deflection direction perpendicular to a direction the handle 62 is inserted into the cavity 74, i.e. the insertion direction of the handle 62, during insertion and removal of the male attachment portion 18 in and from the female attachment portion 20. An axially opening recess 92 is provided opening from the first end 70 of the male attachment portion 18 to the free end of the locking projection 84 to provide the first end 70 with flex. Alternatively, as shown by the male attachment portion 94 in FIGS. 24-26, which is substantially the same as the male attachment portion 18, the male attachment portion 94 is closed at first end 96 such that material is provided between the first end 96 and the free end of the tab 98.

The male attachment portion 18 also has first and second axially extending portions 100 and 102 each having a substantially similar cross-section sized to be received in the corresponding axially extending portion 50, 52 of the female attachment portion 18. The cross-section of the first axially extending portion 100 is larger than the cross-section of the second axially extending portion 102. At the end of the first axially extending portion 100 opposite the end adjacent the second axially extending portion 102 is a ledge 104. The ledge 104 has a first side that can abutthe first end 40 of the female attachment portion 20 when the male and female attachment portions 18 and 20 are engaged such that the first end 40 of the female attachment portion 20 serves as a stop for the male attachment portion 18, and a second side that abuts and supports the cap 60 when the male attachment portion 18 and the cap 60 are affixed.

Referring now to FIGS. 14-23, the cap 60 has a first end 110 with a cross-section matching a cross-section of the handle 62 and a second end 112 with a cross-section matching the cross-section of the male attachment portion 18. In the illustrated embodiment, the first end 110 of the cap 60 is substantially circular in cross-section and the second end 112 of the cap 60 is substantially triangular in cross-section. The cap 60 is advanced over the first end 70 of the male attachment portion 18 until the second end 112 of the cap 60 abuts the second side of the ledge 104.

The cap 60 includes an opening 114 that aligns with the opening 82 in the male attachment portion 18 for receiving the fastener to secure the handle 62 to the male attachment portion 18. The fastener also secures the cap 60 to the male attachment portion 18. The openings 82 and 114 are aligned by alignment members 116 (FIG. 13) and 118 of the male attachment portion 18 and cap 60, respectively, that mate with one another to restrict relative rotation of the cap 60 relative to the male attachment portion 18 in addition to aligning the male attachment portion 18 and the cap 60. In the illustrated embodiment, the alignment member 118 of the cap 60 is a groove and the alignment member 116 of the male attachment portion 18 is a projection. The groove and projection extend axially along the male attachment portion 18 and cap 60 respectively to assist in providing for anti-rotation of the components. It will be appreciated however that the alignment member of the male attachment portion 18 may be a groove and the alignment member of the cap 60 may be a projection, or the alignment members may be other suitable alignment members.

Figure 29:
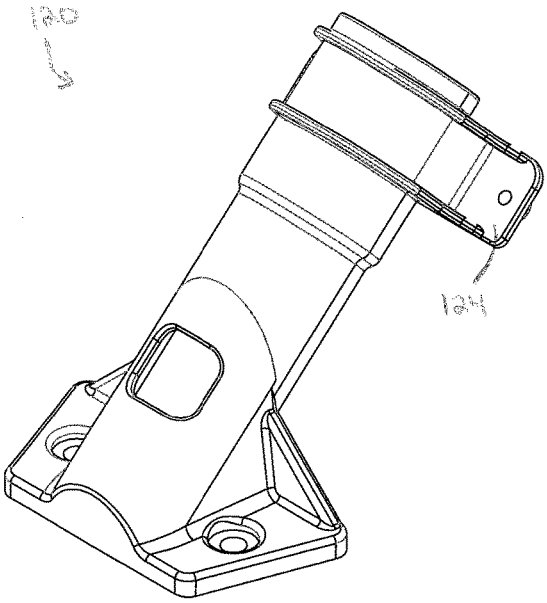
FIG. 29 is a perspective view of yet another representative embodiment of a female attachment portion.
Figure 30:
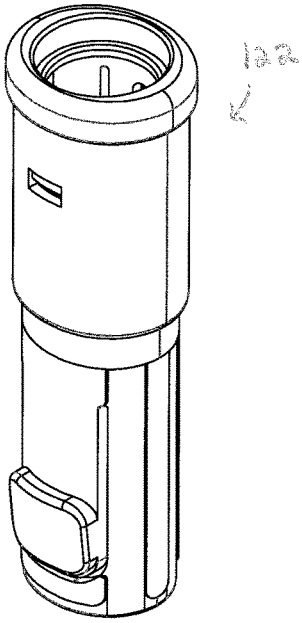
FIG. 30 is a perspective view of a handle assembly for use with the female attachment portion of FIG. 29.
Figure 31:
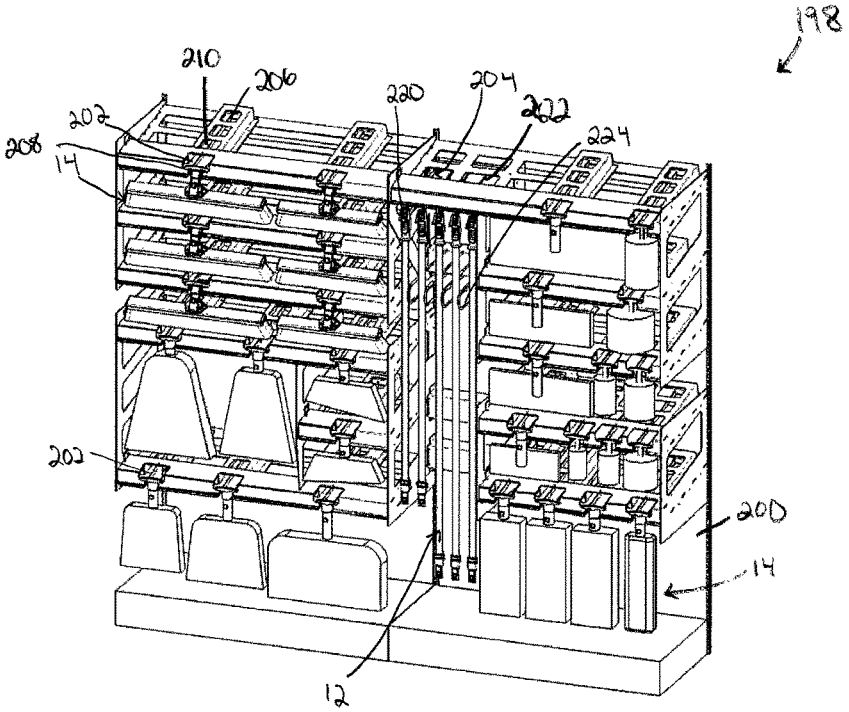
FIG. 31 is a perspective view of a representative embodiment of a merchandizing display.

Referring again to FIGS. 1-4, the male and female attachment portions 18 and 20 have corresponding cross-sections that prevent rotation of the handle relative to the cleaning head 30 when engaged. In the illustrated embodiment, the male and female attachment portions 18 and 20 each have substantially triangular cross-sections to prevent rotation of the handle 62 relative to the cleaning head 30 when engaged. It will be appreciated however that the male and female attachment portions 18 and 20 may have other suitable cross-sections. For example, as shown by the male and female attachment portions 120 and 122 in FIGS. 29 and 30, which are substantially the same as the male and female attachment portions 18 and 20, the male and female attachment portions 120 and 122 may have a substantially circular cross-section. The female attachment portion 122 is also shown attached to a bracket 124 in any suitable manner. The bracket 124 may be used in any of the above female attachment portions, and may be attached to supports connected to the cleaning head 30 to provide additional structural support. It will be appreciated that aspects of the male and female attachment portions may be substituted for one another or used in conjunction with one another where applicable.

The corresponding alignment members 48 and 80 of the female and male attachment portions 20 and 18 also act to restrict relative rotation of the male attachment portion 18 relative to the female attachment portion 20 while serving to align the male and female attachment portions 18 and 20. In the illustrated embodiment, the alignment member 48 of the female attachment portion 20 is a groove and the alignment member 80 of the male attachment portion 20 is a projection. The groove and projection extend axially along the respective attachment portions to assist in providing for anti-rotation of the components. It will be appreciated however that the alignment member of the male attachment portion 18 may be a groove and the alignment member of the female attachment portion 20 may be a projection, or the alignment members may be other suitable alignment members.

To assemble the cleaning device 10, the handle assembly 12 and the cleaning head assembly 14 are advanced towards one another in the insertion direction. The alignment member 80 of the male attachment portion 18 is aligned with the alignment member 48 of the female attachment portion 20, thereby aligning the male and female attachment portions 18 and 20, and the first end 70 of the male attachment portion 18 is inserted into the cavity 44 of the female attachment portion 20 at the first end 40. The male attachment portion 18 is prevented from rotating relative to the female attachment portion 20 by the alignment members and the substantially triangular cross-section of the male and female attachment portions 18 and 20. As the male attachment portion 18 is advanced through the cavity 44, the locking projection 84 is deflected in the deflection direction by the wall of the female attachment portion 18 that forms the cavity 44. The male attachment portion 18 is advanced until the transition area between the first and second axially extending portions 100 and 102 contacts the shoulder 54, the first side of the ledge 104 abuts the first end 40 of the female attachment portion 20, and/or the first end 70 of the male attachment portion 18 contacts a bottom of the cavity 44. At this point the locking projection 84 will deflect in the deflection direction towards the receptacle 46 such that the catch 88 moves through and engages the receptacle 46 to engage the male attachment portion 18 with the female attachment portion 20.

To disassemble the cleaning device, the catch 88 is deflected in the deflection direction away from the receptacle 46 by a user to disengage the male and female attachment portions 18 and 20, and the male attachment portion 18 is moved out of the cavity 44. The locking projection 84 will be deflected by the wall of the female attachment portion 20 as the male attachment portion 18 is being removed from the cavity 44, and the locking projection 84 will move back to its unbiased position once removed from the cavity 44.

Figure 37:
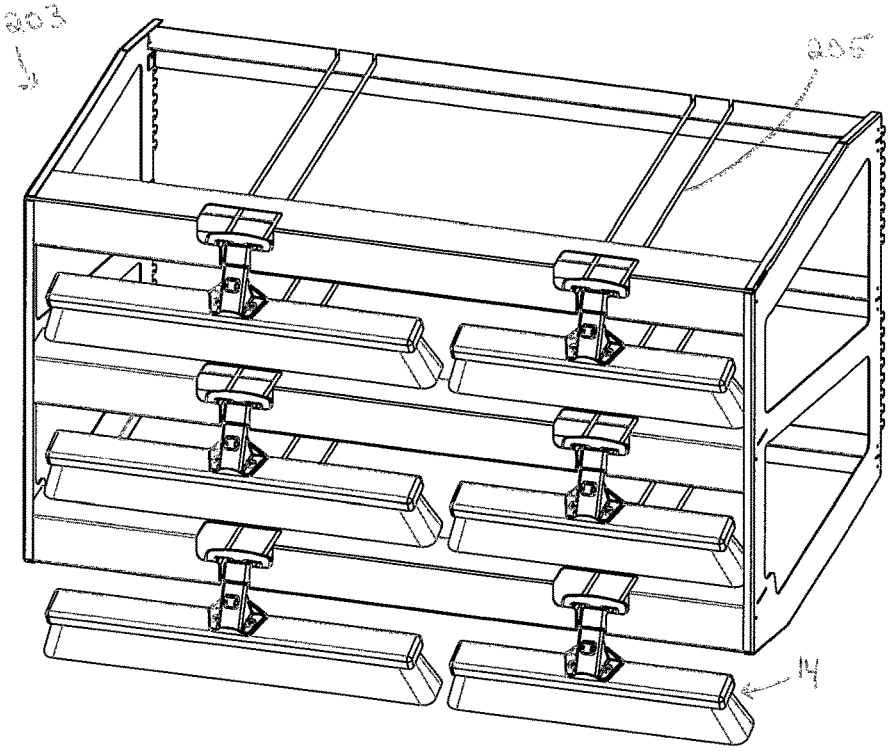
FIG. 37 is a perspective view of another representative embodiment of a merchandizing display.
Figure 38:
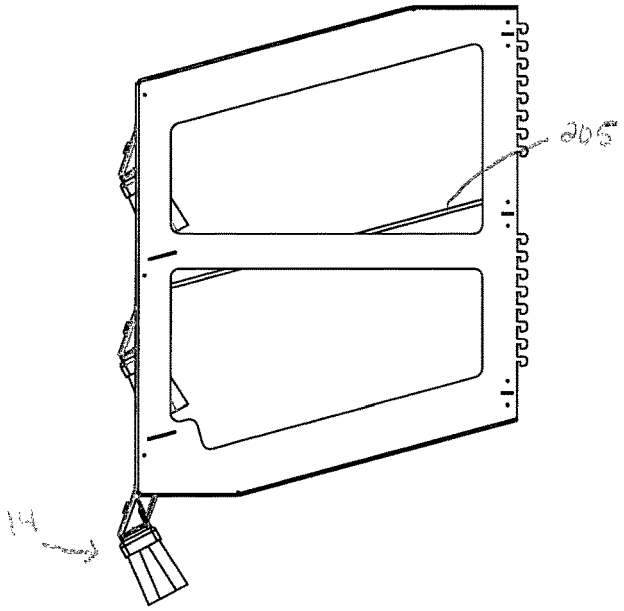
FIG. 38 is a side view of the merchandizing display of FIG. 37.

Turning now to FIGS. 31-36, a merchandizing system 198 for displaying a plurality of cleaning head assemblies 14 and a plurality of handle assemblies 12 will be described in detail. The merchandizing system 198 includes a display wall 200, a plurality of pairs of rail arms 202 extending relative to the display wall 200, a plurality of different cleaning head assemblies 14, a plurality of hook arms 204, and a plurality of different handle assemblies 12. In the illustrated embodiment, the rail arms 202 are formed by stamping sheet metal, although it will be appreciated that the rail arms may be formed in any suitable manner and may be made of any suitable material, such as metal, plastic, etc. For example, as shown by the merchandizing system 203 in FIGS. 37 and 38, which is substantially the same as the merchandizing system 198, the rail arms 205 may be wire form rail arms. It will be appreciated that aspects of the merchandizing systems may be substituted for one another or used in conjunction with one another where applicable.

Figure 32:
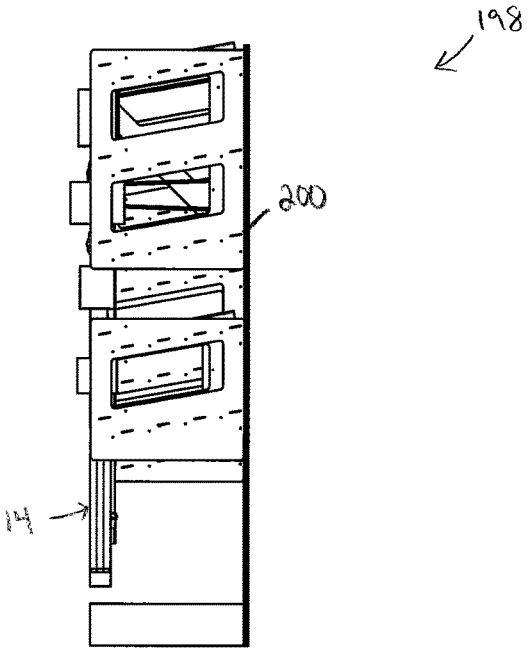
FIG. 32 is a side view of the merchandizing display.

The rail arms 202 have a first end 206 attached to the display wall 200, a second end 208 extending away from the display wall, and a support surface 210 for supporting the cleaning head assemblies 14. As best shown in FIG. 32, the rail arms 202 are angled downward to allow the cleaning head assemblies 14 to be gravity fed but turn upward at the second end 208 to prevent the cleaning head assemblies 14 from falling off the rail arms 202. The rail arms also have a length sufficient to display a plurality of cleaning head assemblies 14.

Figure 44:
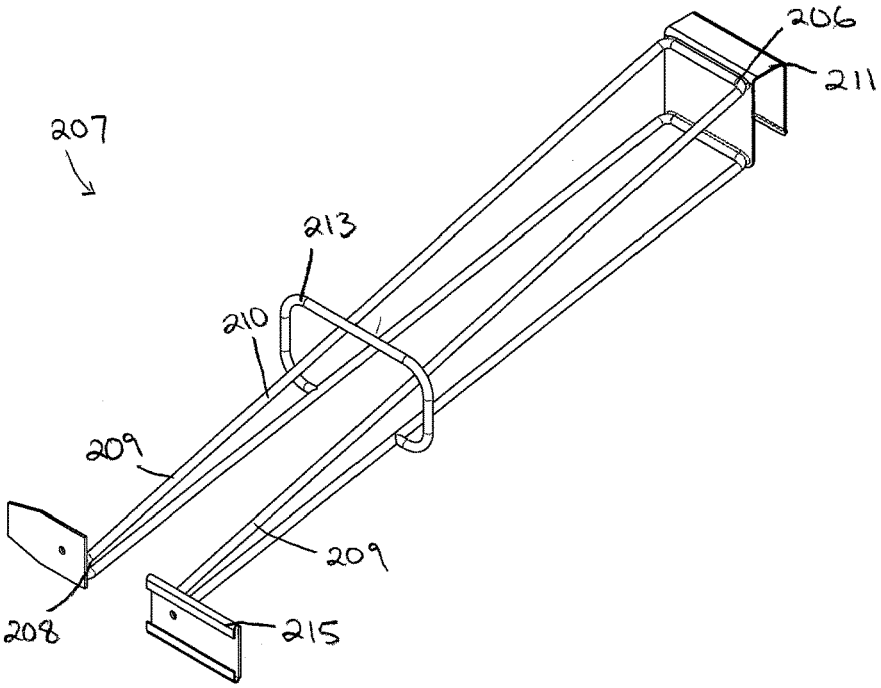
FIG. 44 is a perspective view of another representative embodiment of a rail arm.

FIG. 44 shows another exemplary rail arm assembly 207, which is substantially the same as the rail arms 202. It will be appreciated that aspects of the rail arms may be substituted for one another or used in conjunction with one another where applicable. The rail arm assembly 207 is a wire form assembly including a pair of arms 209 that may be separate from one another or unitarily formed as shown. The rail arms include a first end 206 attached to a hook portion 211 that attaches to a display wall, a second end 208 extending away from the display wall, and a support surface 210 for supporting the cleaning head assemblies 14. The rail arms also includes a loop 213 that wraps around the arms to hold the assembly together. The first ends 206 may be attached to a display wall in any suitable manner, such as by the hook portion 211, such as a c-shaped portion that seats on a horizontal surface, by a peg end configured to be received in a perforated hardboard, etc. The rail arms 209 are angled downward and either turn upward at the second end 208 or includes a stop 215 to prevent the cleaning head assemblies 14 from falling off the rail arms 209. One or more of the stops 215 may have an area for receiving a display tag, which may include price, model number, etc.

The plurality of hook arms 204, which may be formed in any suitable manner and may be made of any suitable material, such as metal, plastic, etc., are provided for supporting the handle assemblies 12. Each hook arm 204 has a first end (not shown) attached to the display wall 200, a second end 220 extending away from the display wall, and a support surface 222 extending therebetween. Each handle assembly may have a loop at an end opposite the end from the male attachment portion 18, or have a loop such as a cable tie loop attached to the opposite end, that engages the support surface 222. In the illustrated embodiment, the plurality of hook arms 204 may be axially spaced to support various handle assemblies 12, and a plurality of spacer member 224 may extend from the display wall 200 below respective hook arms 204 to separate the handle assemblies 12. The hook arms 204 are angled downward to allow the handle assemblies 12 to be gravity fed from the back towards the front, and have a length sufficient to display a plurality of handle assemblies 12.

The merchandizing display 198 includes dedicated areas for different handle assemblies 12 and different cleaning head assemblies 14, thereby reducing display space and displaying the handle assemblies and cleaning head assemblies in an orderly manner that will increase efficiency in stocking. Providing the handle assemblies and cleaning head assemblies separate from one another also increases shipping efficiency and safety, for example by reducing space required for shipping.

Referring now to FIGS. 33-36, to support the cleaning head assemblies 14 on the rail arms 202, a hanging mechanism 230 is provided that engages the support surface 208 and releaseably engages the cleaning head assemblies 14. The hanging mechanism 230 includes a male attachment portion 232 for releasable engagement with the female attachment portion 20 of the cleaning head 12 for display of the cleaning head 30. The male attachment portion 232 has a locking projection 234 proximate a free end of the male attachment portion 232 that engages the receptacle 46 to be disposed in or extend beyond the receptacle 46. The male attachment portion 232 is resiliently deflectable in a deflection direction perpendicular to the insertion direction of the hanging mechanism, during insertion and removal of the male attachment portion 232 in and from the female attachment portion 20.

Figure 33:
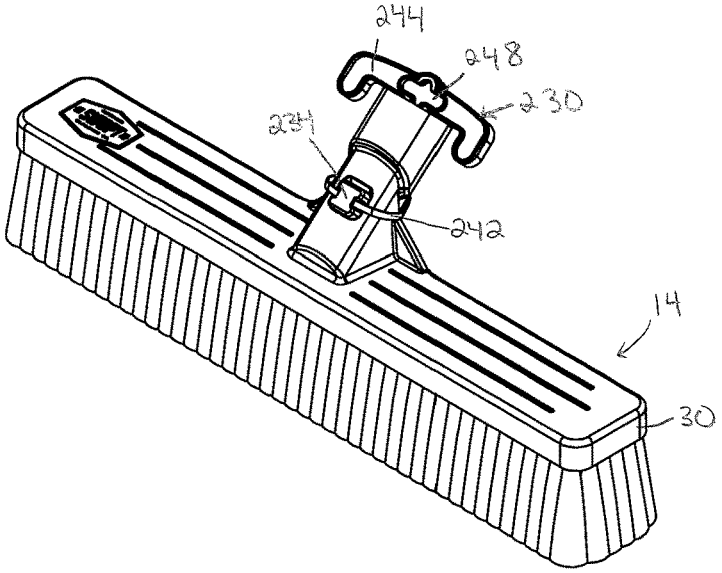
FIG. 33 is a perspective view of the cleaning head assembly affixed to a merchandizing hanger.
Figure 34:
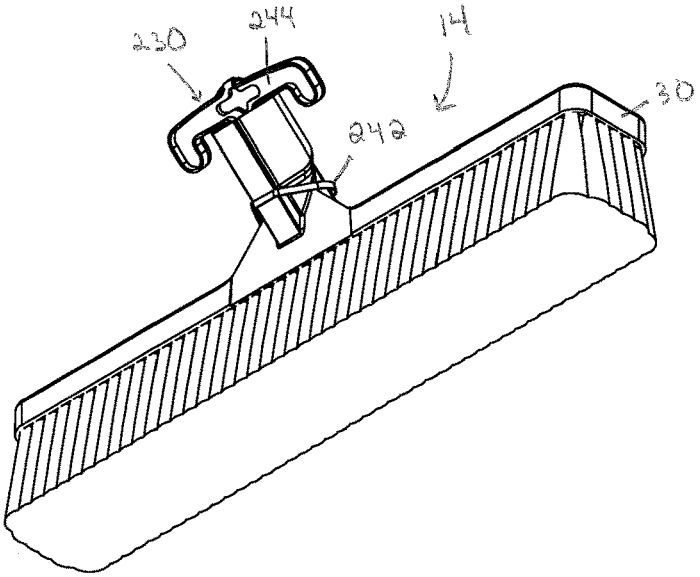
FIG. 34 is another perspective view of the cleaning head assembly affixed to the merchandizing hanger.
Figure 35:
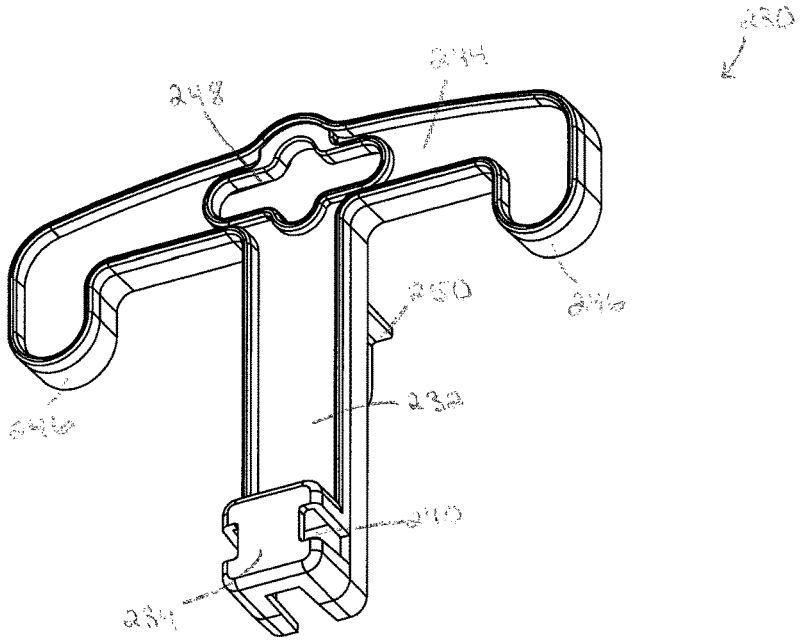
FIG. 35 is a perspective view of the merchandizing hanger.
Figure 36:
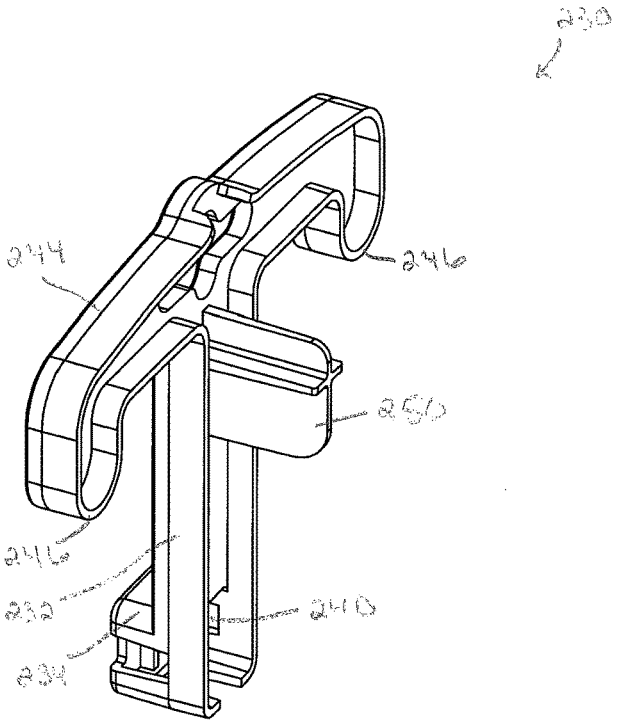
FIG. 36 is another perspective view of the merchandizing hanger.

The locking projection 234 has an opening 240 extending therethrough for receiving a securing member 242, such as a cable tie, to prevent disengagement of the locking projection 234 of the hanging mechanism from the receptacle 46 of the female attachment portion 20, thereby providing an anti-theft feature. When the locking projection 234 is engaged with the receptacle 46, the opening 240 extends out of the female attachment portion 20 past the receptacle 46 as shown in FIG. 33. After a user has purchased the cleaning head assembly 14, the cable tie can be removed and the hanging mechanism 230 discarded. The anti-theft feature thereby prevents a user from connecting a handle assembly 12 and a cleaning head assembly 14 in the store, thereby preventing the user from intentionally or unintentionally paying for only one of the assemblies. The anti-theft feature also assists in maintaining order in the display by preventing users from assembling the handle assembly and cleaning head assembly, the user is prevented from putting the assembled cleaning head back on the display in an area where it does not fit.

The hanging mechanism 230 also includes a laterally extending portion 244 substantially perpendicular to the male attachment portion 232 such that the hanging mechanism 230 is substantially t-shaped. The laterally extending portion 244 and the male attachment portion 232 may be a one-piece construction or may be separate components coupled in any suitable manner. The laterally extending portion 244 is configured to interact with the pair of rail arms 202 to support the cleaning head assembly 14 on the rail arms 202. The laterally extending portion 244 may include a guide 246 extending from both ends of the laterally extending portion 244 in a direction parallel to the male attachment portion 232 for partially wrapping around sides of the rail arms 202 for additional stability. The laterally extending portion 244 may also have an opening 248 extending therethough to allow the hanging mechanism 230 to be hung on a single hook arm, such as the hook arm 204.

Extending rearwardly from the male attachment portion 232 is a rearward projection 250 perpendicular to both the male attachment portion 232 and the laterally extending portion 244. The rearward projection 250 engages the wall in the cavity 44 to assist in preventing the male attachment portion 232 from inadvertently disengaging from the female attachment portion 20. In the illustrated embodiment, the rearward projection 250 is substantially t-shaped, although any suitable shape may be used.

Turning now to FIGS. 39-42, an exemplary embodiment of the merchandizing system is shown at 298. The merchandizing system 298 is substantially the same as the above-referenced merchandizing system 198, and consequently the same reference numerals but indexed by 100 are used to denote structures corresponding to similar structures in the merchandizing systems. In addition, the foregoing description of the merchandizing system 198 is equally applicable to the merchandizing system 298 except as noted below. It will be appreciated that aspects of the merchandizing assemblies may be substituted for one another or used in conjunction with one another where applicable.

The merchandizing system includes a rail arm 302 extending relative to the display wall and a plurality of cleaning head assemblies 14. Although not shown, it will be appreciated that a plurality of rail arms 302 may be provided and a plurality of hook arms and handle assemblies may also be provided. The rail arm 302 has a first end 306 attached to the display wall, a second end 308 extending away from the display wall, and a support surface 310 for supporting the cleaning head assemblies 14. The rail arms 302 are angled downward to allow the cleaning head assemblies 14 to be gravity fed, and have a length sufficient to display a plurality of cleaning head assemblies 14.

Figure 43:
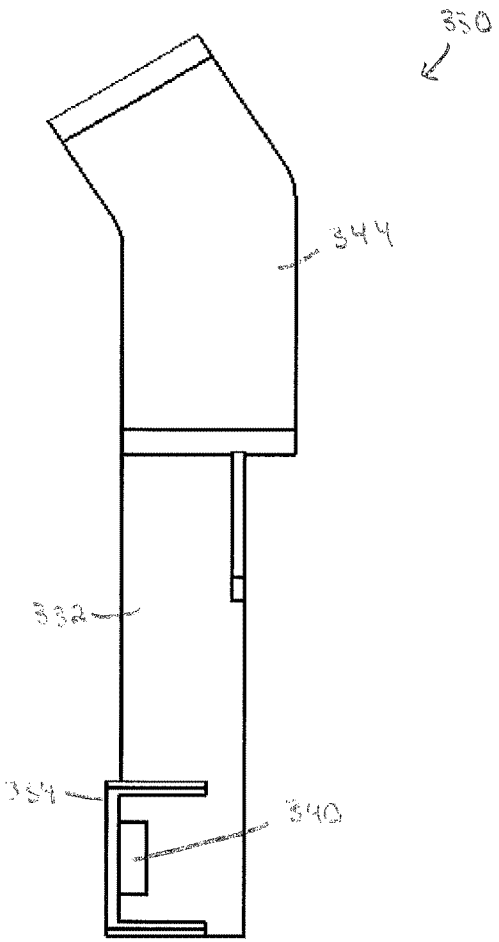
FIG. 43 is a side view of the merchandizing hanger of FIG. 42.
Figure 42:
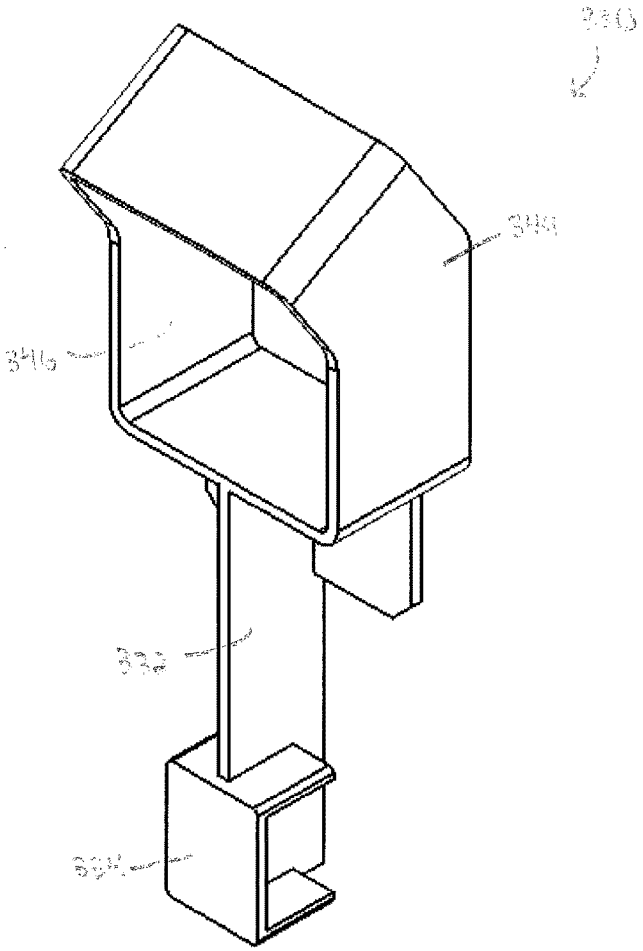
FIG. 42 is a perspective view of another representative embodiment of a merchandizing hanger.

Referring now to FIGS. 42 and 43, to support the cleaning head assemblies 14 on the rail arm 302, a hanging mechanism 330 is provided that engages the support surface 308 and releaseably engages the cleaning head assemblies 14. The hanging mechanism 330 includes a male attachment portion 332 for releasable engagement with the female attachment portion 20 of the cleaning head 12 for display of the cleaning head 30. The male attachment portion 332 has a locking projection 334 that engages the receptacle 46. The male attachment portion 332 is resiliently deflectable in a deflection direction perpendicular to the insertion direction of the hanging mechanism. The locking projection 334 has an opening 340 extending therethrough for receiving a securing member, such as a cable tie, frangible member, etc., to prevent disengagement of the locking projection 334 of the hanging mechanism from the receptacle 46 of the female attachment portion 20. The hanging mechanism 330 also includes a hanging portion 344 extending from the male attachment portion 332 and defining an opening 346. A top inner surface of the opening 346 is configured to interact with the rail arm 202 to support the cleaning head assembly 14 on the rail arm 202.

Figure 39:
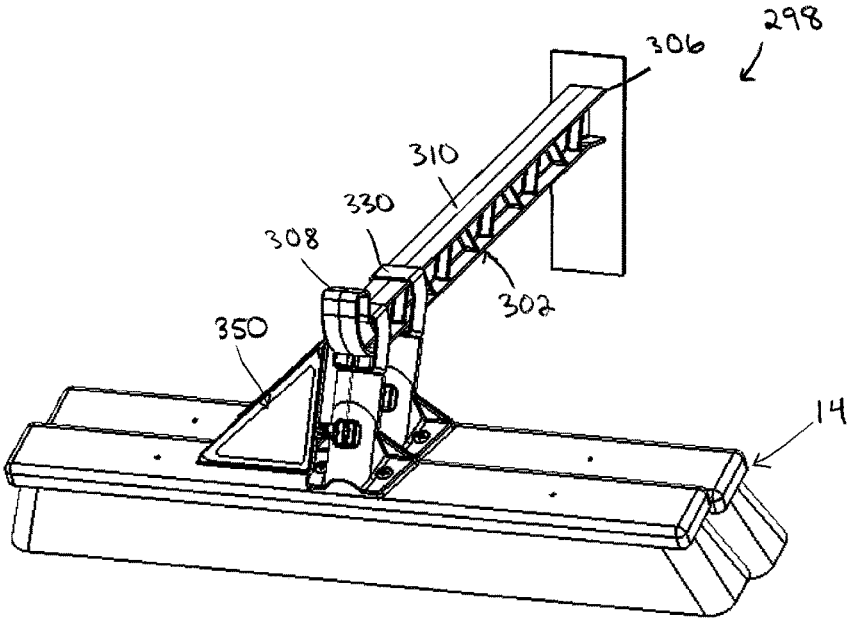
FIG. 39 is a perspective view of a portion of another representative embodiment of a merchandizing display.
Figure 40:
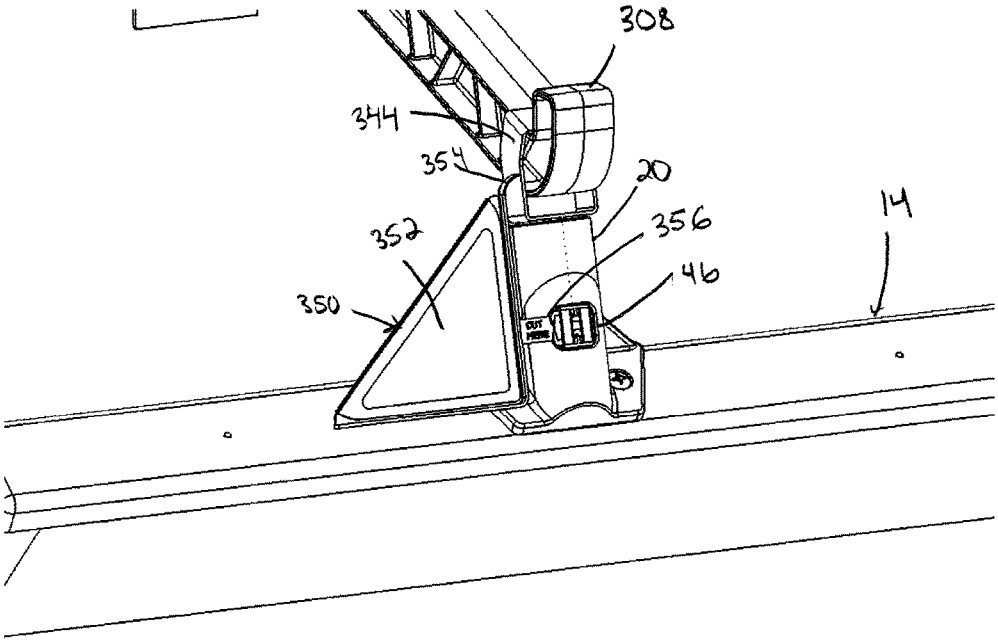
FIG. 40 is another perspective view of the merchandizing display of FIG. 39.
Figure 41:
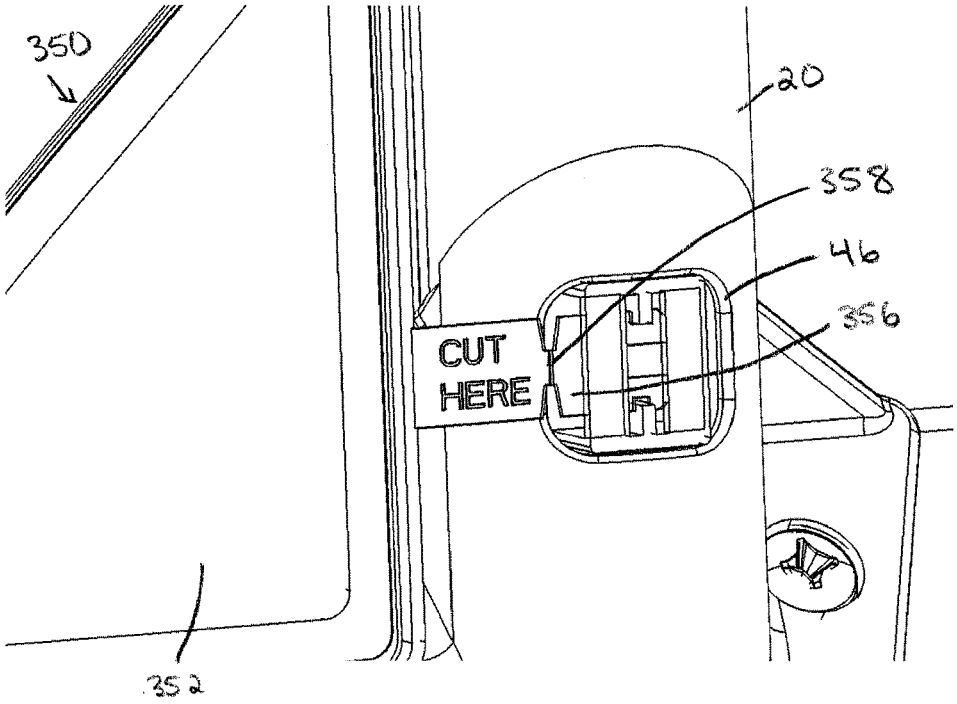
FIG. 41 is an enlarged view of a portion of the merchandizing display of FIG. 40.

As shown in FIGS. 39-41, the hanging mechanism 330 includes a frangible member 350 for securing the hanging mechanism 330 to the female attachment portion 20. The frangible member 350 has a body 352, a hinge portion 354 having a first portion attached at or near the hanging portion 344 and a second portion attached to the body 352 allowing the body to be flexed towards the receptacle 46, and a connector 356 for engaging the opening 340, such as by a snap connection. Once the connector 356 engages the opening 340, the hanging mechanism 330 is prevented from being disengaged from the female attachment portion 20 until the connector 356 is cut or otherwise broken at the cut area 358 and the connector 356 removed from the opening 340, thereby providing an anti-theft feature. It will be appreciated that the frangible member 350 may be attached to the hanging mechanism 330 or may be integrally formed with the hanging mechanism as shown.

Figure 45:
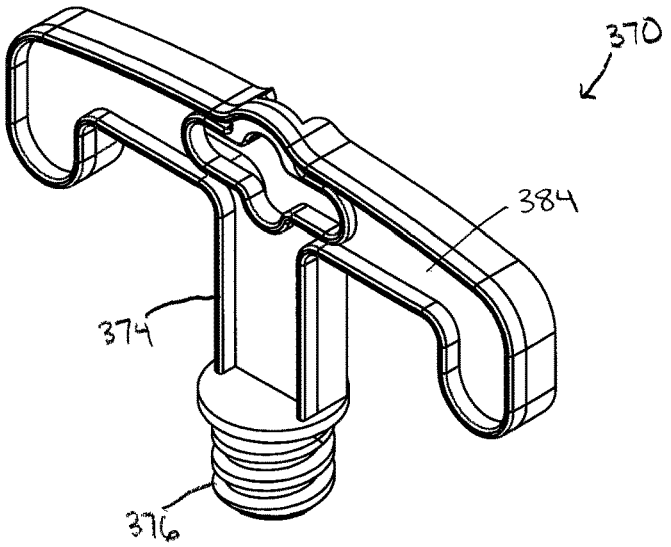
FIG. 45 is a perspective view of another representative embodiment of a merchandizing hanger.
Figure 46:
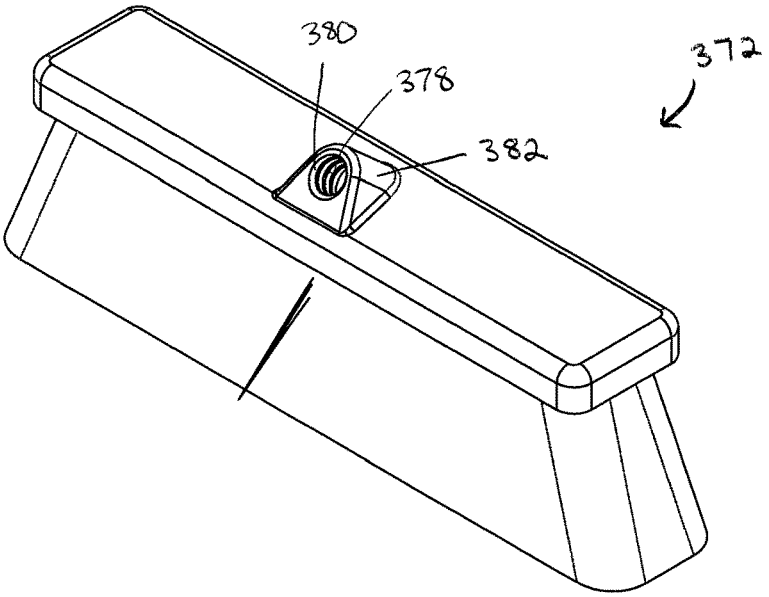
FIG. 46 is a perspective view of another representative embodiment of a cleaning head assembly.
Figure 47:
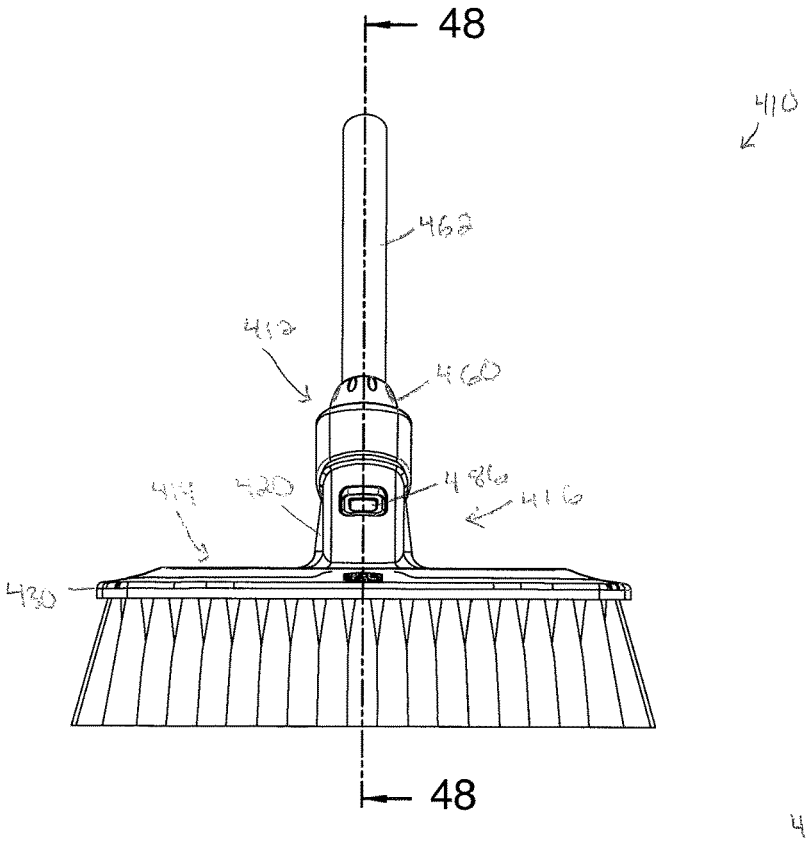
FIG. 47 is a front view of another representative embodiment of a cleaning device.
Figure 48:
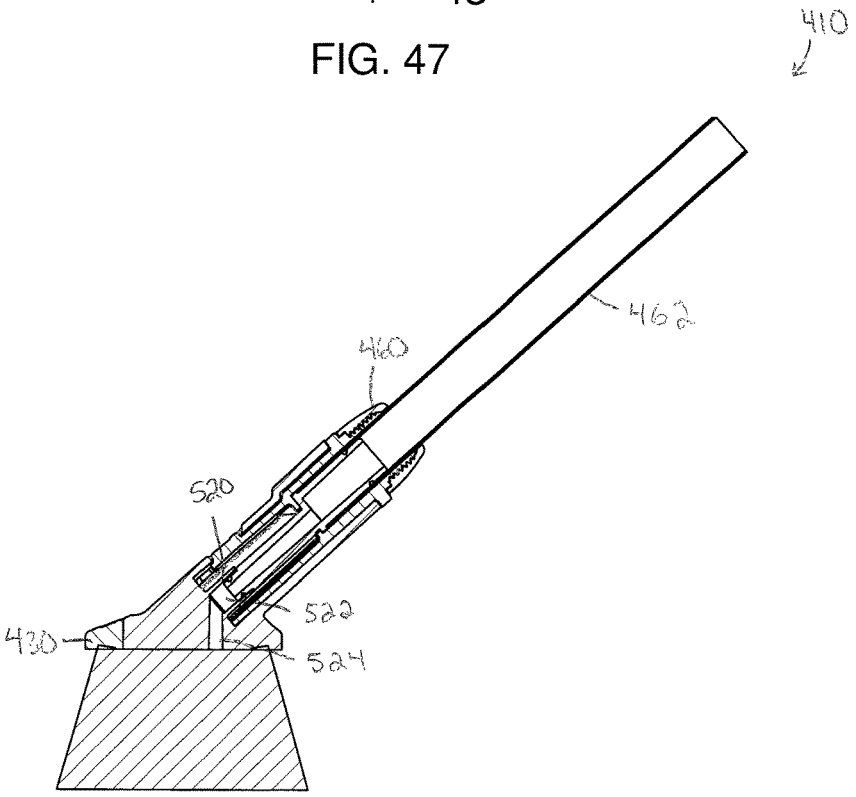
FIG. 48 is a cross-sectional view of the cleaning device taken about line 48-48 in FIG. 47.
Figure 49:
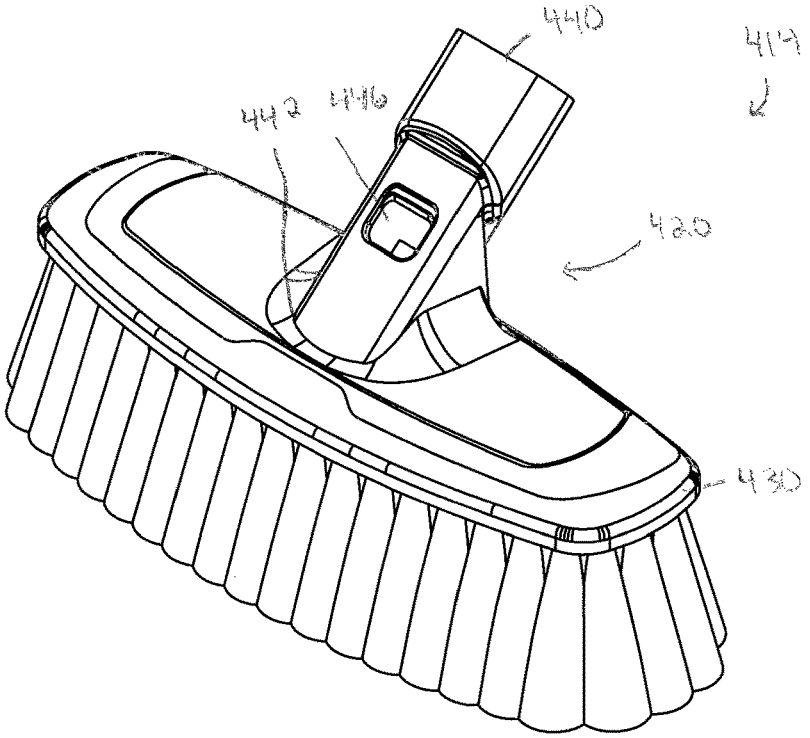
FIG. 49 is a perspective view of a cleaning head assembly of the cleaning device.
Figure 50:
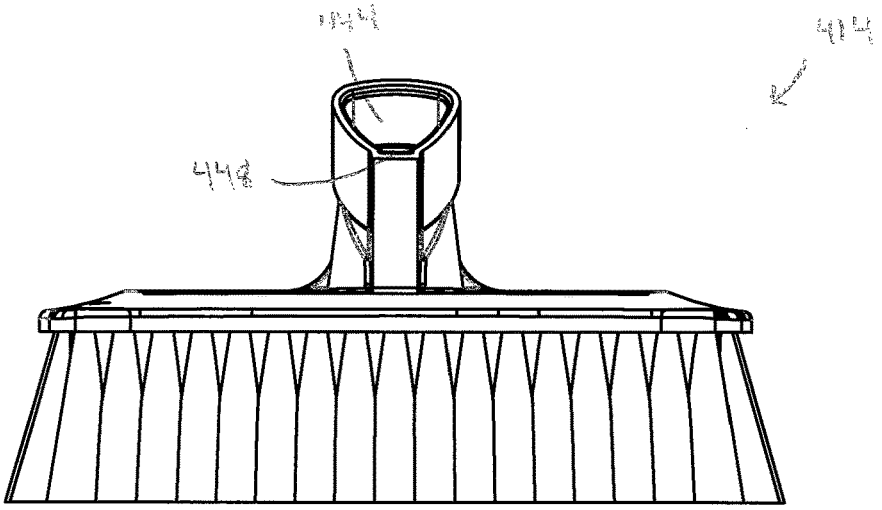
FIG. 50 is a rear view of the cleaning head assembly.
Figure 51:
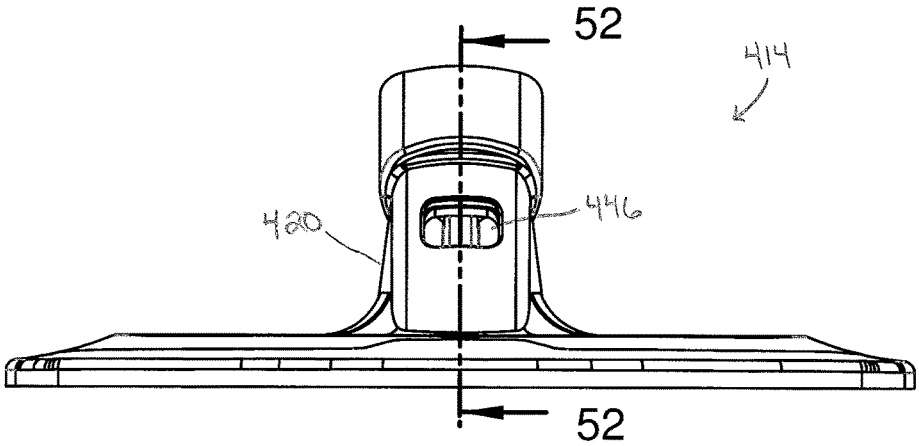
FIG. 51 is a front view of the cleaning head assembly with the bristles of the cleaning head removed.

Turning now to FIGS. 45 and 46, a hanging mechanism 370 and a cleaning head assembly 372 are shown. The hanging mechanism 370 and cleaning head assembly 372 are substantially the same as the hanging mechanism 230 and cleaning head assembly 14, and thus the foregoing description of the hanging mechanism 230 and cleaning head assembly 14 is equally applicable to the hanging mechanism 370 and cleaning head assembly 372 except as noted below. It will be appreciated that aspects of the hanging mechanisms and cleaning head assemblies may be substituted for one another or used in conjunction with one another where applicable.

The hanging mechanism 370 includes a male attachment portion 374 having threads 376 for engaging corresponding threads 378 in a receptacle 380 of a female attachment portion 382 of the cleaning head assembly 372. The male attachment portion 374 and female attachment portion 382 may each have an opening (not shown) for receiving a securing member to prevent disengagement of the hanging mechanism and cleaning head assembly. The hanging mechanism 370 also includes a laterally extending portion 384 substantially perpendicular to the male attachment portion 374 such that the hanging mechanism 370 is substantially t-shaped.

Turning now to FIGS. 47-57, an exemplary embodiment of the cleaning device is shown at 410. The cleaning device 410 is substantially the same as the above-referenced cleaning device 10, and consequently the same reference numerals but indexed by 400 are used to denote structures corresponding to similar structures in the cleaning devices. In addition, the foregoing description of the cleaning device 10 is equally applicable to the cleaning device 410 except as noted below. It will be appreciated that aspects of the cleaning devices may be substituted for one another or used in conjunction with one another where applicable.

The cleaning device includes a handle assembly 412 removably attachable to a cleaning head assembly 414 using a locking mechanism 416 that includes a male attachment portion 418 forming part of the handle assembly 412 and a female attachment portion 420 forming part of the cleaning head assembly 414. The cleaning head assembly 414 includes the female attachment portion 420 and a cleaning head 430. The female attachment portion 420 has a first end 440, a second end 442, an axially extending cavity 444 for receiving the male attachment portion 418, a receptacle 446 extending through a wall of the female attachment portion 420, and an alignment member 448.

Figure 52:
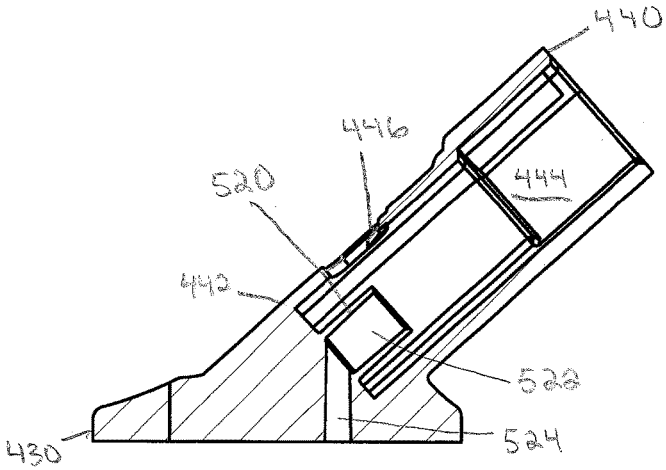
FIG. 52 is a cross-sectional view of the cleaning head assembly of FIG. 51 taken about line 52-52 in FIG. 51.
Figure 56:
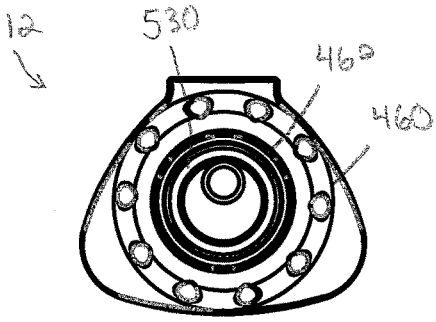
FIG. 56 is a top view of the handle assembly.
Figure 57:
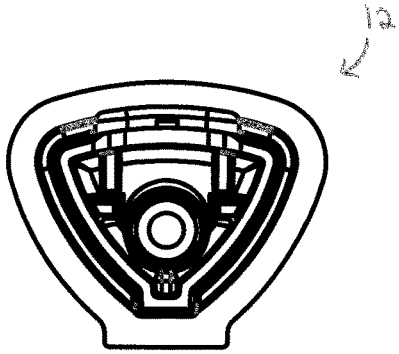
FIG. 57 is a bottom view of the handle assembly.

As best shown in FIG. 52, the female attachment portion 420 also includes a spout receptacle 520 extending into the cavity 444 from the second end 442 and being radially inwardly spaced from the walls defining the cavity 444. The spout receptacle 520 defines a cavity 522 that is in fluidic communication with a passage 524 in the cleaning head 430. The passage 524 extends through the cleaning head 430 to an underside of the cleaning head to allow fluid flow out of the cleaning head 430, for example onto the bristles of the cleaning head.

The handle assembly 412 includes the male attachment portion 418, a cap 460 secured to the male attachment portion 418, and a handle 462 affixed to the male attachment portion 418. The cap 460 includes threads 464 on an inner surface thereof for mating with threads 466 on an outer surface of the male attachment portion 418. The handle 462 includes a passage 468 extending therethrough for water or other fluid to flow through the handle 462.

The male attachment portion 418 has a first end 470, a second end 472, an axially extending cavity 474, an alignment member 480, a locking projection 484 biased to engage the receptacle 446, and a ledge 504. The locking projection 484 has tab 486, a catch 488 that engages the receptacle 446, and a projection 490 at an end of the tab 486. An axially opening recess 492 is provided opening from the first end of the male attachment portion 418 to the free end of the locking projection 484. The ledge 504 has a first side that abuts the first end 440 of the female attachment portion 420, and a second side that abuts and supports the cap 460. The portion of the male attachment portion 418 above the ledge 502 at the second end 472 is substantially circular for mating with the substantially circular cap 460 and for receiving the substantially circular handle 462.

Figure 55:
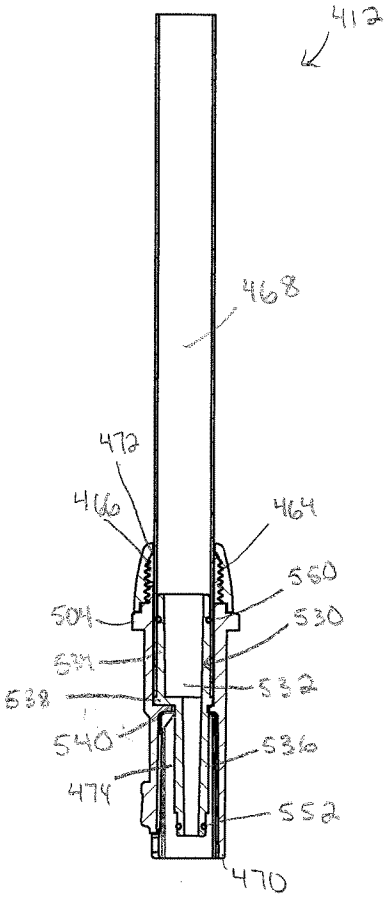
FIG. 55 is a cross-sectional view of the handle assembly taken about line 55-55 in FIG. 54.
Figure 54:
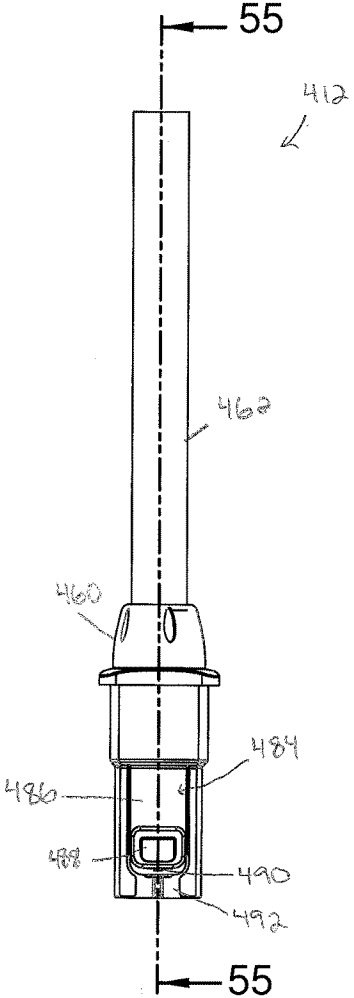
FIG. 54 is a front view of the handle assembly.
Figure 53:
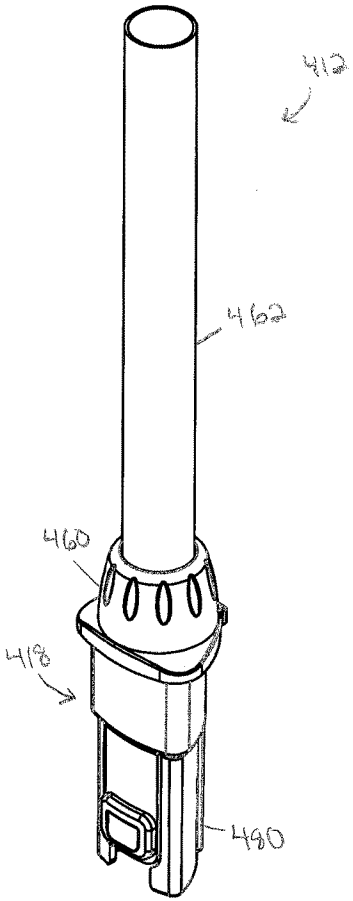
FIG. 53 is a perspective view of a handle assembly of the cleaning device.

As best shown in FIG. 55, the handle assembly 412 also includes a fluid adapter 530 disposed in the cavity 474 and defining a cavity 532 that is in fluidic communication with the passage 468 and the cavity 522. The adapter 530 includes a first portion 534 and a second portion 536, where the diameter of the first portion is larger than the diameter of the second portion. The area between the portions 534 and 536 defines a ledge 538 that has a first side that abuts a ledge 540 in the cavity 474 to serve as a stop for the adapter 530 and a second side. The second portion 536 is spaced from the locking projection 484 so as to not interfere with deflection of the locking projection.

The adapter also includes first and second seals 550 and 552, which may be any suitable seals, such as O-rings, disposed in respective seal grooves at opposite ends of the adapter 530. The first seal 550 is configured to seal against an inner surface of the handle 462, and the second seal 552 is configured to seal against an inner surface of the spout receptacle 520 in the cavity 522.

To assemble the handle assembly 412, the adapter 530 and handle 462 are inserted into the cavity 474. The adapter 530 can first be inserted into the passage 468 of the handle and then inserted into the cavity 474, or the adapter 530 can be inserted into the cavity 474 and then the handle 462 inserted into the cavity between the walls defining the cavity 474 and the outer wall of the first portion 534. In either example, a second side of the ledge 538 serves as a stop for the handle 462. The adapter 530 may be coupled to the handle 462 in any suitable manner, such as by swaging, or the adapter and handle may be held together by the connection between the cap 460/male attachment portion 18/handle 462.

The cap 460 can then be advanced over the handle 462, or alternatively be positioned near the second end 472 of the male attachment portion 418 and the handle 462 be advanced through the cap 460. In either example, once the handle 462 and adapter 530 are positioned, the cap 460 is threaded onto the second end 472 of the male attachment portion. As the cap 460 is threaded onto the second end 472, the cap 460 compresses the second end 472 against the handle 462 thereby creating a friction fit to hold the handle 462 in the male attachment portion 418.

To assemble the cleaning device 410, the handle assembly 412 and the cleaning head assembly 414 are advanced towards one another in the insertion direction. The alignment member 480 of the male attachment portion 418 is aligned with the alignment member 448 of the female attachment portion 20, and the first end 470 of the male attachment portion 418 is inserted into the cavity 444 of the female attachment portion 420 at the first end 440. As the male attachment portion 418 is advanced through the cavity 444, the locking projection 484 is deflected in the deflection direction by the wall of the female attachment portion 418 that forms the cavity 444. The male attachment portion 418 is advanced until the male attachment portion contacts the shoulder 454, the first side of the ledge 504 abuts the first end 440 of the female attachment portion 420, and the end of the second portion 534 is disposed in and sealed to the cavity 522 of the spout receptacle 530. At this point the locking projection 484 will deflect in the deflection direction towards the receptacle 446 such that the catch 488 moves through and engages the receptacle 446 to engage the male attachment portion 418 with the female attachment portion 420. The end of the handle 462 opposite the end in the male attachment portion 418 can then be connected to a fluid supply, such as a hose, thereby allowing fluid, such as water, paint, etc., to flow through the passage 468 to the cavity 532, through the cavity 532 to the cavity 522, and then through the cavity 522 to the passage 524.

Additional aspects of the disclosure will be understood from the appended claims, which form part of this specification.

What is claimed is:

1. A merchandizing system for displaying cleaning head assemblies, the system including:

a pair of rail arms configured to extend from a display wall;

a cleaning head assembly having a female attachment portion having a receptacle and a cleaning head; and a hanging mechanism having:

a male attachment portion for releasable engagement with the female attachment portion of the cleaning head assembly, the male attachment portion having a locking projection proximate a free end of the male attachment portion and extending forwardly from the male attachment portion in a first direction for engagement with the receptacle, a laterally extending portion configured to contact a top of the pair of rail arms and extending substantially perpendicular to the male attachment portion, and a projection extending rearwardly from the male attachment portion perpendicular to the male attachment portion and the laterally extending portion in a second direction opposite the first direction for engaging an inner wall of the receptacle, wherein the cleaning head assembly is configured to be supported from the rail arms by the hanging mechanism.

2. The merchandizing system according to claim 1, wherein the pair of rail arms includes a plurality of pairs of rail arms, and wherein the hanging mechanism includes a plurality of hanging mechanisms, where each of the plurality of hanging mechanisms hangs from one of the plurality of pairs of rail arms.

3. The merchandizing system according to claim 1, wherein the laterally extending portion includes a guide extending from both ends of the laterally extending portion in a direction parallel to the male attachment portion.

4. The merchandizing system according to claim 1, wherein the laterally extending portion defines an opening, and wherein a top inner surface of the opening is configured to interact with one of the rail arms to support the cleaning head assembly on the rail arm.

5. The merchandizing system according to claim 1, wherein the hanging mechanism includes a frangible member for securing the male attachment portion of the hanging mechanism to the female attachment portion of the cleaning head assembly.

6. The merchandizing system according to claim 1, wherein the male attachment portion of the hanging mechanism is adapted to be received in the female attachment portion and the locking projection is adapted to extend out of the female attachment portion when engaged with the receptacle.

7. The merchandizing system according to claim 1, wherein the locking projection has an opening extending therethrough for receiving a securing member to prevent disengagement of the locking projection from the receptacle.

8. The merchandizing system according to claim 7, wherein when the hanging mechanism is engaged with the cleaning head assembly, the opening in the locking projection extends out of the female attachment portion past the receptacle.

9. A merchandizing system for displaying cleaning head assemblies, the system including:

a plurality of rail arms configured to extend from a display wall;

a plurality of cleaning head assemblies each having an attachment portion and a cleaning head; and a plurality of hanging mechanisms each having an attachment portion for releasable engagement with one of the attachment portions of the cleaning head assemblies, wherein the cleaning head assemblies are configured to be supported from the rail arms by the hanging mechanisms, wherein the plurality of rail arms are angled downward to allow the cleaning head assemblies to be gravity fed, wherein the attachment portion of each cleaning head assembly is a female attachment portion and the attachment portion of each hanging mechanism is a male attachment portion, wherein each female attachment portion has a receptacle for receiving and engaging with the respective male attachment portion to releasably lock the cleaning head and the hanging mechanism together, wherein the male attachment portion has a locking projection engageable with the receptacle to releasably lock the cleaning head and the hanging mechanism together, and wherein the male attachment portion of the hanging mechanism is adapted to be received in the female attachment portion and the locking projection is adapted to extend out of the receptacle of the female attachment portion beyond an outer surface of the female attachment portion when engaged with the receptacle.

10. The merchandizing system according to claim 9, wherein the locking projection of the hanging mechanism has an opening extending therethrough for receiving a securing member to prevent disengagement of the locking projection of the hanging mechanism from the receptacle of the female attachment portion.

11. The merchandizing system according to claim 10, wherein when one of the hanging mechanisms is engaged with one of the cleaning head assemblies, the opening in the locking projection extends out of the female attachment portion past the receptacle.

12. The merchandizing system according to claim 9, wherein the plurality of rail arms includes a plurality of pairs of rail arms, and wherein each hanging mechanism hangs from a pair of the rail arms.

13. The merchandizing system according to claim 12, wherein each hanging mechanism includes a laterally extending portion substantially perpendicular to the male attachment portion such that the hanging mechanism is substantially t-shaped, and wherein the laterally extending portion is configured to interact with one of the pairs of rail arms.

14. The merchandizing system according to claim 13, wherein each laterally extending portion includes a guide extending from both ends of the laterally extending portion in a direction parallel to the male attachment portion.

15. A merchandizing system for displaying cleaning head assemblies, the system including:

a pair of rail arms configured to extend from a display wall;

a cleaning head assembly having a female attachment portion having a receptacle and a cleaning head; and a hanging mechanism configured to support the cleaning head assembly from the pair of rail arms, the hanging mechanism having a male attachment portion adapted to be received in the female attachment portion, the male attachment portion having a locking projection engageable with the receptacle to releasably lock the cleaning head and the hanging mechanism together, wherein the locking projection is adapted to extend out of the receptacle of the female attachment portion beyond an outer surface of the female attachment portion when engaged with the receptacle.

16. The merchandizing system according to claim 15, wherein the hanging mechanism has a laterally extending portion configured to contact a top of the pair of rail arms, the male attachment portion extending in a first direction from the laterally extending portion substantially perpendicular to the laterally extending portion, a first guide extending in the first direction from an end of the laterally extending portion substantially parallel to the male attachment portion, and a second guide extending in the first direction from another end of the laterally extending portion substantially parallel to the male attachment portion, and wherein the first and second guides are configured to extend in the first direction outside of the rail arms to stabilize the hanging mechanism on the rail arms.

17. The merchandizing system according to claim 15, wherein the hanging mechanism additionally includes a projection extending rearwardly from the male attachment portion perpendicular to the male attachment portion and the laterally extending portion for engaging an inner wall of the receptacle.

18. The merchandizing system according to claim 15, wherein the locking projection of the hanging mechanism has an opening extending therethrough that is beyond an outer surface of the female attachment portion when engaged with the receptacle for receiving a securing member to prevent disengagement of the locking projection of the hanging mechanism from the receptacle of the female attachment portion.

* * * * *